US012534874B2

(12) United States Patent
Nishi

(10) Patent No.: US 12,534,874 B2
(45) Date of Patent: Jan. 27, 2026

(54) SHOVEL THAT OPERATES WITHIN SET BOUNDARIES

(71) Applicant: SUMITOMO CONSTRUCTION MACHINERY CO., LTD., Tokyo (JP)

(72) Inventor: Takashi Nishi, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 856 days.

(21) Appl. No.: 17/030,831

(22) Filed: Sep. 24, 2020

(65) Prior Publication Data

US 2021/0010236 A1 Jan. 14, 2021

Related U.S. Application Data

(63) Continuation of application No. PCT/JP2019/012599, filed on Mar. 25, 2019.

(30) Foreign Application Priority Data

Mar. 26, 2018 (JP) ..... 2018-058915

(51) Int. Cl.

| | |
|---|---|
| ***E02F 9/20*** | (2006.01) |
| ***E02F 3/43*** | (2006.01) |
| ***E02F 9/26*** | (2006.01) |

(52) U.S. Cl.

CPC ..... *E02F 9/2033* (2013.01); *E02F 3/431* (2013.01); *E02F 9/2004* (2013.01); *E02F 9/265* (2013.01); *E02F 9/2037* (2013.01)

(58) Field of Classification Search

CPC ..... E02F 9/2033; E02F 3/431; E02F 9/2004; E02F 9/265; E02F 9/2037

See application file for complete search history.

(56) References Cited

U.S. PATENT DOCUMENTS

| | | | | |
|---|---|---|---|---|
| 4,863,337 A * | 9/1989 | Ishiguro | ..... | E02F 9/2033 60/459 |
| 6,169,948 B1 * | 1/2001 | Fujishima | ..... | E02F 9/26 340/684 |
| 2011/0178677 A1 * | 7/2011 | Finley | ..... | E02F 9/265 701/50 |
| 2014/0267731 A1 * | 9/2014 | Izumikawa | ..... | B60R 1/23 348/148 |

(Continued)

FOREIGN PATENT DOCUMENTS

| | | |
|---|---|---|
| JP | H07-292708 | 11/1995 |
| JP | H08-027841 | 1/1996 |

(Continued)

OTHER PUBLICATIONS

International Search Report for PCT/JP2019/012599 mailed on Jun. 11, 2019.

*Primary Examiner* — Christopher J Sebesta
*Assistant Examiner* — Blake E Scoville
(74) *Attorney, Agent, or Firm* — IPUSA, PLLC

(57) ABSTRACT

A shovel includes a lower traveling body, an upper turning body turnably mounted on the lower traveling body, an actuator mounted on the lower traveling body or the upper turning body, and a controller configured to restrict movement of the actuator. The controller sets a virtual wall, and restricts the movement of the actuator based on a positional relationship between the virtual wall and the shovel.

12 Claims, 20 Drawing Sheets

(56) References Cited

U.S. PATENT DOCUMENTS

| | | | | |
|---|---|---|---|---|
| 2015/0247301 | A1* | 9/2015 | Wighton | E02F 3/18 701/50 |
| 2018/0087244 | A1 | 3/2018 | Deguchi et al. | |

FOREIGN PATENT DOCUMENTS

| | | | | |
|---|---|---|---|---|
| JP | H09-071965 | | 3/1997 | |
| JP | 2003-027530 | | 1/2003 | |
| JP | 2006-257724 | | 9/2006 | |
| JP | 2008224625 | A * | 9/2008 | |
| JP | 2009-150218 | | 7/2009 | |
| JP | 2012-021290 | | 2/2012 | |
| JP | 2013-151830 | | 8/2013 | |
| JP | 2013151830 | A * | 8/2013 | |
| JP | 2013159930 | A * | 8/2013 | |
| JP | 2015-214855 | | 12/2015 | |
| JP | 2016-176289 | | 10/2016 | |
| JP | 2017-155563 | | 9/2017 | |
| WO | 2017/056269 | | 4/2017 | |
| WO | WO-2017056269 | A1 * | 4/2017 | E02F 9/0858 |
| WO | 2017/094627 | | 6/2017 | |
| WO | WO-2017188230 | A1 * | 11/2017 | B60R 21/00 |

* cited by examiner

SHOVEL THAT OPERATES WITHIN SET BOUNDARIES

CROSS-REFERENCE TO RELATED APPLICATION

The present application is a continuation of International Application No. PCT/JP/2019/012599, filed on Mar. 25, 2019, which claims priority to Japanese Application No. JP2018-058915, filed on Mar. 26, 2018, the entire content of each of which is incorporated herein by reference.

BACKGROUND

Technical Field

The disclosures herein relate to a shovel serving as an excavator.

Description of Related Art

An excavator that includes an attachment and a turning mechanism is known. The excavator is configured to stop the turning operation of the attachment when the excavator detects an approaching object and determines that there is a high likelihood that the attachment will collide with the object.

SUMMARY

According to an embodiment of the present invention, a shovel includes a lower traveling body, an upper turning body turnably mounted on the lower traveling body, an actuator mounted on the lower traveling body or the upper turning body, and a controller configured to restrict movement of the actuator. The controller sets a virtual wall, and restricts the movement of the actuator based on a positional relationship between the virtual wall and the shovel.

BRIEF DESCRIPTION OF THE DRAWINGS

Other objects and further features of the present invention will be apparent from the following detailed description when read in conjunction with the accompanying drawings, in which.

DETAILED DESCRIPTION

If no object approaches the excavator, the excavator does not stop the turning operation of the attachment. Therefore, there is a possibility that the attachment may enter a space where the attachment is not expected to enter.

In view of the above, it is desirable to more appropriately restrict the movement of a shovel.

Figure 1A:
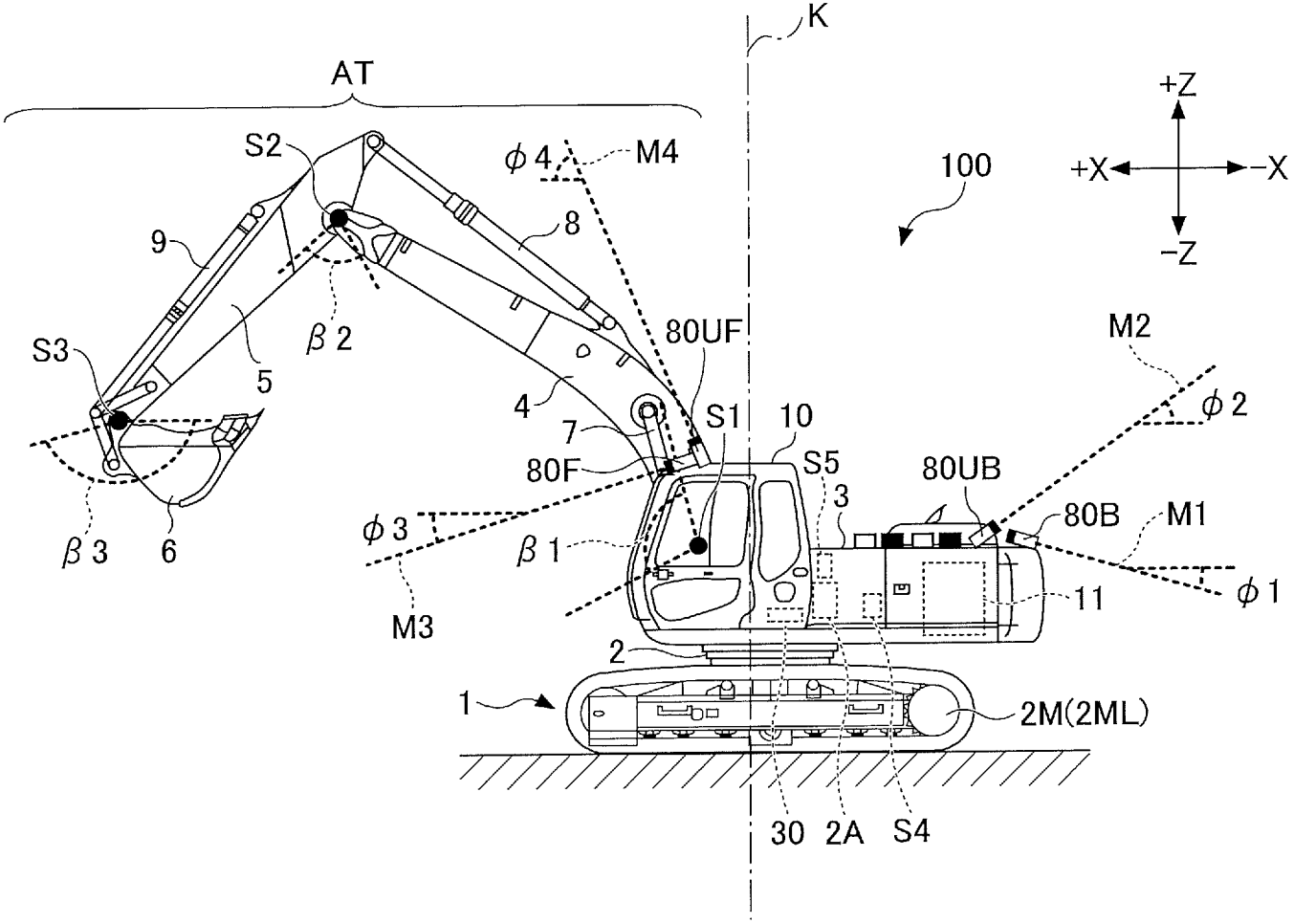
FIG. 1A is a side view of a shovel according to an embodiment of the present invention.
Figure 1B:
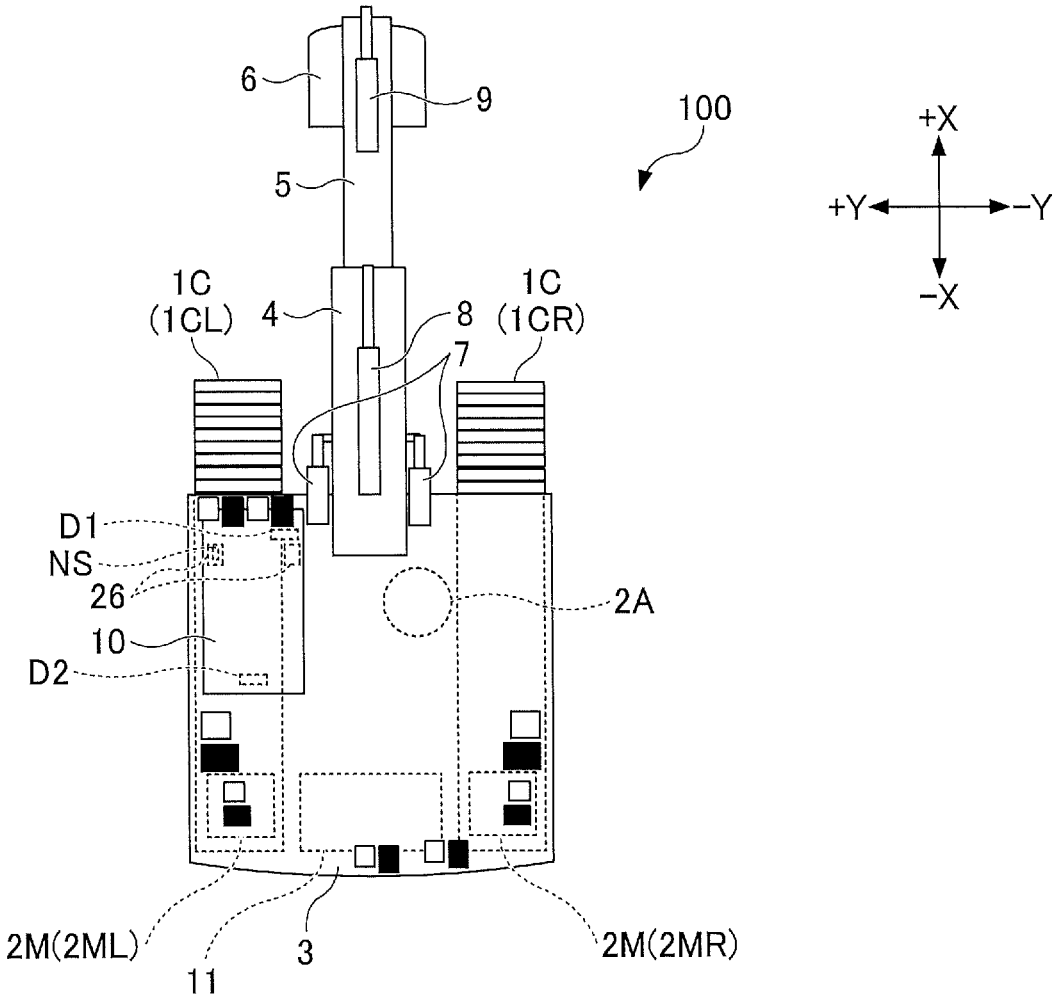
FIG. 1B is a top view of the shovel according to the embodiment of the present invention.
Figure 10:
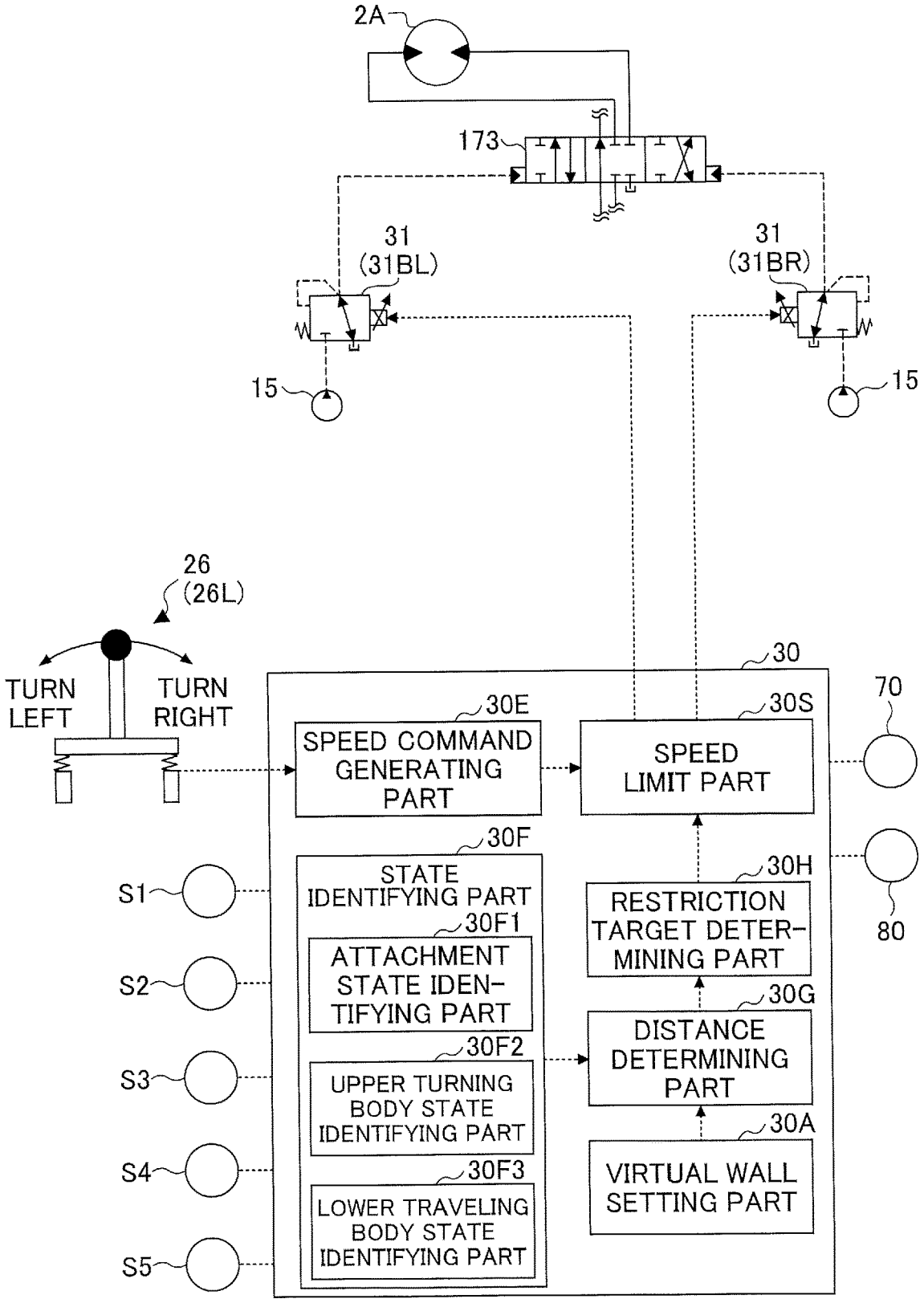
FIG. 10 is a diagram illustrating another example configuration of a controller.

First, a shovel 100 serving as an excavator according to an embodiment of the present invention will be described with reference to FIG. 1A through FIG. 1D. FIG. 1A and FIG. 10 are side views of the shovel 100. FIG. 1B and FIG. 1D are top views of the shovel 100. FIG. 1A is the same as FIG. 10 except for reference numerals and auxiliary lines, and FIG. 1B is the same as FIG. 10 except for reference numerals and auxiliary lines.

In the present embodiment, the shovel 100 includes hydraulic actuators. The hydraulic actuators include a left traveling hydraulic motor 2ML, a right traveling hydraulic motor 2MR, a turning hydraulic motor 2A, a boom cylinder 7, an arm cylinder 8, and a bucket cylinder 9.

A lower traveling body 1 of the shovel 100 includes crawlers 1C. The crawlers 1C are driven by traveling hydraulic motors 2M mounted on the lower traveling body 1. Specifically, the crawlers 1C include a left crawler 1CL and a right crawler 1CR. The left crawler 1CL is driven by a left traveling hydraulic motor 2ML, and the right crawler 1CR is driven by a right traveling hydraulic motor 2MR.

An upper turning body 3 is turnably mounted on the lower traveling body 1 via a turning mechanism 2. The turning mechanism 2 is driven by a turning hydraulic motor 2A mounted on the upper turning body 3. However, the turning hydraulic motor 2A may be a turning electric motor serving as an electric actuator.

A boom 4 is mounted on the upper turning body 3. An arm 5 is attached to the end of the boom 4, and a bucket 6, which serves as an end attachment, is attached to the end of the arm 5. The boom 4, the arm 5, and the bucket 6 constitute an excavation attachment AT, which is an example of an attachment. The boom 4 is driven by the boom cylinder 7, the arm 5 is driven by the arm cylinder 8, and the bucket 6 is driven by the bucket cylinder 9.

The boom 4 is supported so as to be pivotable relative to the upper turning body 3. A boom angle sensor S1 is attached to the boom 4. The boom angle sensor S1 can detect a boom angle β1 that is the rotation angle of the boom 4. The boom angle β1 is, for example, a climb angle from the lowermost position of the boom 4. Therefore, the boom angle β1 maximizes when the boom 4 is raised most.

The arm 5 is supported so as to be pivotable relative to the boom 4. An arm angle sensor S2 is attached to the arm 5. The arm angle sensor S2 can detect an arm angle β2 that is the rotation angle of the arm 5. The arm angle β2 is, for example, an opening angle from the most closed position of the arm 5. Therefore, the arm angle β2 maximizes when the arm 5 is most open.

The bucket 6 is supported so as to be pivotable relative to the arm 5. A bucket angle sensor S3 is attached to the bucket 6. The bucket angle sensor S3 can detect a bucket angle β3 that is the rotation angle of the bucket 6. The bucket angle β3 is an opening angle from the most closed position of the bucket 6. Therefore, the bucket angle β3 maximizes when the bucket 6 is most open.

According to the embodiment of FIG. 1A through FIG. 1D, each of the boom angle sensor S1, the arm angle sensor S2, and the bucket angle sensor S3 is constituted of a combination of an acceleration sensor and a gyroscope. However, at least one of the boom angle sensor S1, the arm angle sensor S2, and the bucket angle sensor S3 may be constituted of an acceleration sensor alone. Further, the boom angle sensor S1 may be a stroke sensor attached to the boom cylinder 7, or may be a rotary encoder, a potentiometer, an inertial measurement unit, or the like. The same applies to the arm angle sensor S2 and the bucket angle sensor S3.

A cabin 10 that is a cab is provided on the upper turning body 3, and a power source such as an engine 11 is mounted on the upper turning body 3. Further, an object detector 70, an image capturing device 80, a body tilt sensor S4, a turning angular velocity sensor S5, and the like are attached to the upper turning body 3. An operation device 26, a controller 30, a display device D1, an audio output device D2, and the like are provided in the cabin 10. In the present specification, for convenience, the side of the upper turning body 3 to which the excavation attachment AT is attached is defined as the front side, and the side of the upper turning body 3 to which a counterweight is attached is defined as the back side.

Figure 1C:
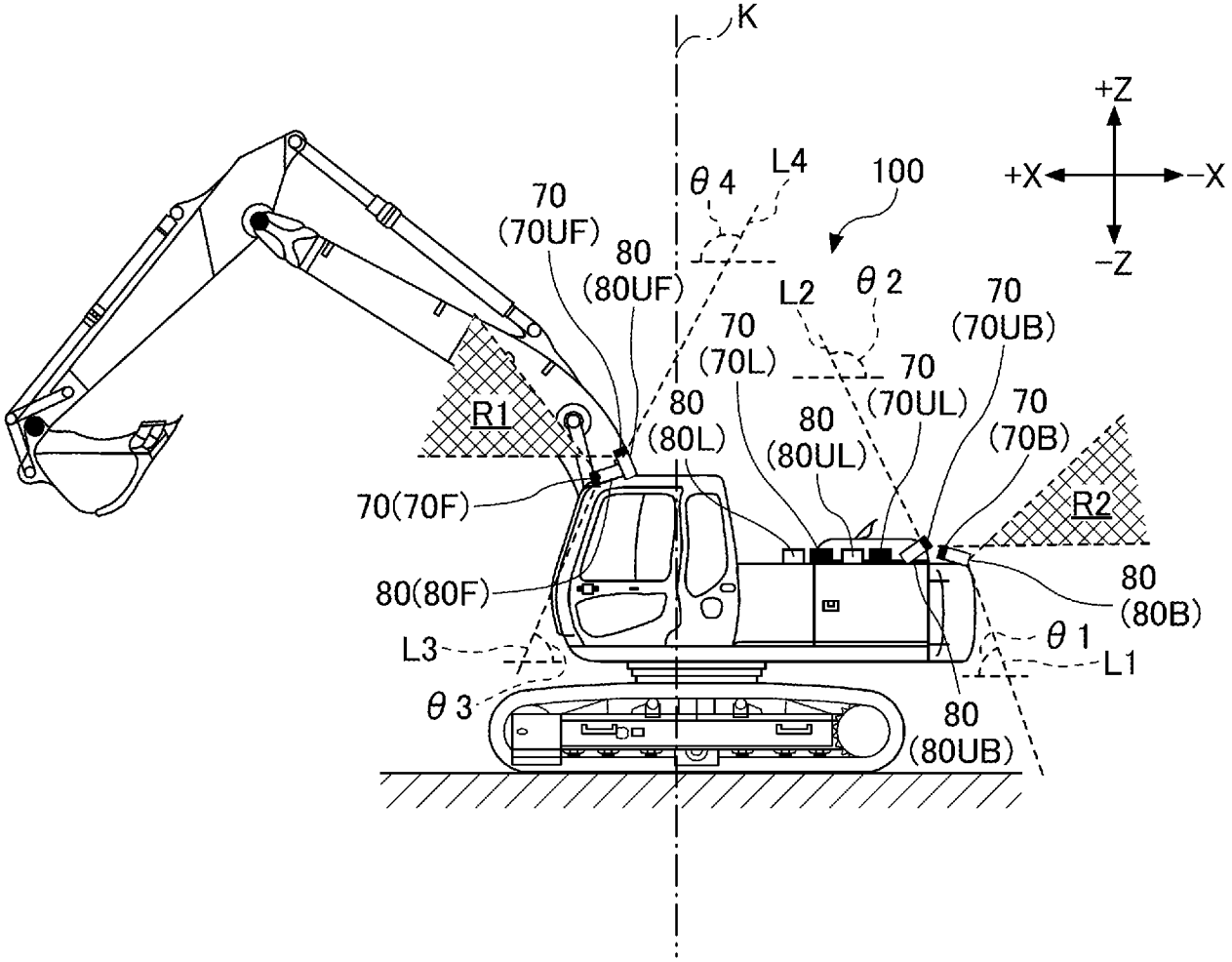
FIG. 1C is a side view of the shovel according to the embodiment of the present invention.
Figure 1D:
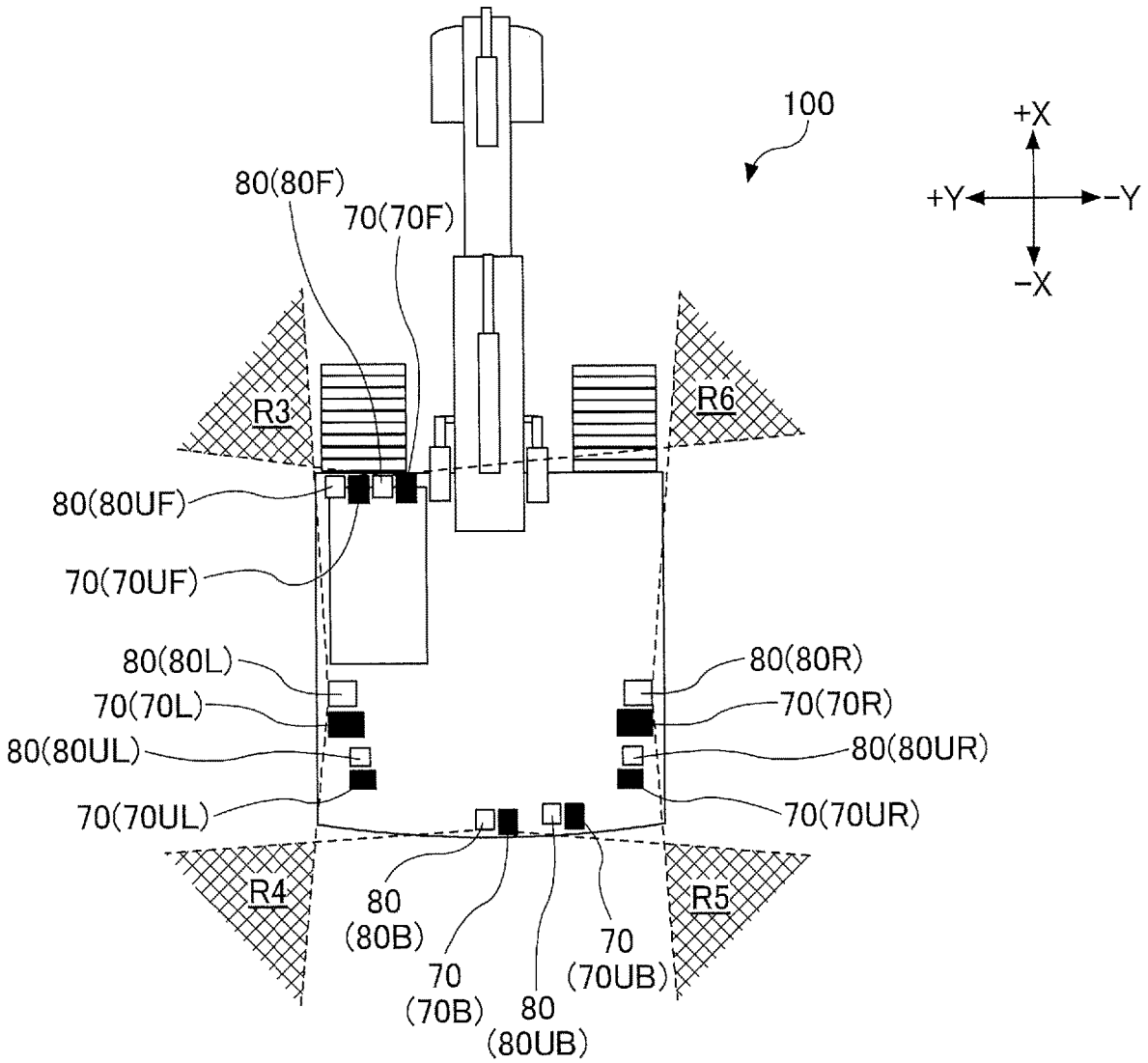
FIG. 1D is a top view of the shovel according to the embodiment of the present invention.

The object detector 70 illustrated in FIG. 1C and FIG. 1D is an example of a surroundings monitoring device, and is configured to monitor objects in the vicinity of the shovel 100. Examples of the objects include people, animals, vehicles, work equipment, construction machines, buildings, walls, fences, and holes. The object detector 70 may be a camera, an ultrasonic sensor, a milliwave radar, a stereo camera, a light detection and ranging (LIDAR), a distance image sensor, or an infrared sensor. In the present embodiment, the object detector 70 includes a rear sensor 70B and an upper rear sensor 70UB, which are LIDARs attached to the rear end of the upper surface of the upper turning body 3, a front sensor 70F and an upper front sensor 70UF, which are LIDARs attached to the front end of the upper surface of the cabin 10, a left sensor 70L and an upper left sensor 70UL, which are LIDARs attached to the left end of the upper surface of the upper turning body 3, and a right sensor 70R and an upper right sensor 70UR, which are LIDARs attached to the right end of the upper surface of the upper turning body 3.

The rear sensor 70B is configured to detect an object located behind and obliquely below the shovel 100. The upper rear sensor 70UB is configured to detect an object located behind and obliquely above the shovel 100. The front sensor 70F is configured to detect an object located in front of and obliquely below the shovel 100. The upper front sensor 70UF is configured to detect an object located to the left and obliquely above the shovel 100. The left sensor 70L is configured to detect an object located to the left and obliquely below the shovel 100. The upper left sensor 70UL is configured to detect an object located to the left and obliquely above the shovel 100. The right sensor 70R is configured to detect an object located to the right and obliquely below the shovel 100. The upper right sensor 70UR is configured to detect an object located to the right and obliquely above The object detector 70 may be configured to detect a predetermined object within a predetermined region set in the vicinity of the shovel 100. For example, the object detector 70 may be configured to distinguish between a person and an object other than a person.

The image capturing device 80 is another example of the surroundings monitoring device, and captures an image of an area surrounding the shovel 100. In the present embodiment, the image capturing device 80 includes a rear camera 80B and an upper rear camera 80UB, attached to the back end of the upper surface of the upper turning body 3, a front camera 80F and an upper front camera 80UF, attached to the front end of the upper surface of the cabin 10, a left camera 80L and an upper left camera 80UL, attached to the left end of the upper surface of the upper turning body 3, and a right camera 80R and an upper right camera 80UR, attached to the right end of the upper surface of the upper turning body 3.

The rear camera 80B is configured to capture an image of a space behind and obliquely below the shovel 100. The upper rear camera 80UB is configured to capture an image of a space behind and obliquely above the shovel 100. The front camera 80F is configured to capture an image of a space in front of and obliquely below the shovel 100. The upper front camera 80UF is configured to capture an image of a space in front of and obliquely above the shovel 100. The left camera 80L is configured to capture an image of a space to the left of and obliquely below the shovel 100. The upper left camera 80UL is configured to capture an image of a space to the left of and obliquely above the shovel 100. The right camera 80R is configured to capture an image of a space to the right of and obliquely below the shovel 100. The upper right camera 80UR is configured to capture an image of a space to the right of and obliquely above the shovel 100.

Specifically, as illustrated in FIG. 1A, the rear camera 80B is configured such that a dashed line M1, which is a virtual line representing the optical axis, forms an angle (angle of depression) φ1 with respect to a virtual plane (in the example of FIG. 1A, a virtual horizontal plane) that is perpendicular to a turning axis K. The upper rear camera 80UB is configured such that a dashed line M2, which is a virtual line representing the optical axis, forms an angle (angle of elevation) φ2 with respect to the virtual plane that is perpendicular to the turning axis K. The front camera 80F is configured such that a dashed line M3, which is a virtual line representing the optical axis, forms an angle (angle of depression) φ3 with respect to the virtual plane that is perpendicular to the turning axis K. The upper front camera 80UF is configured such that a dashed line M4, which is a virtual line representing the optical axis, forms an angle (angle of elevation) φ4 with respect to the virtual plane that is perpendicular to the turning axis K. Although not illustrated, the left camera 80L and the right camera 80R are configured such that the optical axis of each of the left camera 80L and the right camera 80R forms an angle of depression with respect to the virtual plane that is perpendicular to the turning axis K, and the upper left camera 80UL and the upper right camera 80UR are configured such that the optical axis of each of the upper left camera 80UL and the upper right camera 80UR forms an angle of elevation with respect to the virtual plane that is perpendicular to the turning axis K.

In FIG. 10, an area R1 represents a range in which a monitoring range (imaging range) of the front camera 80F overlaps an imaging range of the upper front camera 80UF, and an area R2 represents a range in which an imaging range of the rear camera 80B overlaps an imaging range of the upper rear camera 80UB. That is, the rear camera 80B and the upper rear camera 80UB are arranged such that the imaging ranges of the rear camera 80B and the upper rear camera 80UB partially overlap in the vertical direction, and the front camera 80F and the upper front camera 80UF are arranged such that the imaging ranges of the front camera 80F and the upper front camera 80UF partially overlap in the vertical direction. Further, although not illustrated, the left camera 80L and the upper left camera 80UL are arranged such that the imaging ranges of the left camera 80L and the upper left camera 80UL partially overlap in the vertical direction, and the right camera 80R and the upper right camera 80UR are arranged such that the imaging ranges of the right camera 80R and the upper right camera 80UR partially overlap in the vertical direction.

As illustrated in FIG. 10, the rear camera 80B is configured such that a dashed line L1, which is a virtual line representing the lower boundary of the imaging range of the rear camera 80B, forms an angle (angle of depression) θ1 with respect to the virtual plane (the virtual horizontal plane in the example of FIG. 10) that is perpendicular to the turning axis K. The upper rear camera 80UB is configured such that a dashed line L2, which is a virtual line representing the upper boundary of the imaging range of the upper rear camera 80UB, forms an angle (angle of elevation) θ2 with respect to the virtual plane that is perpendicular to the turning axis K. The front camera 80F is configured such that a dashed line L3, which is a virtual line representing the lower boundary of the imaging range of the front camera 80F, forms an angle (angle of depression) θ3 with respect to the virtual plane that is perpendicular to the turning axis K. The upper front camera 80UF is configured such that a dashed line L4, which is a virtual line representing the upper boundary of the imaging range of the upper front camera 80UF, forms an angle (angle of elevation) θ4 with respect to the virtual plane that is perpendicular to the turning axis K. The angle (angle of depression) θ1 and the angle (angle of depression) θ3 are preferably greater than or equal to 55°. In FIG. 10, the angle (angle of depression) θ1 is approximately 70°, and the angle (angle of depression) θ3 is approximately 65°. The angle (angle of elevation) θ2 and the angle (angle of elevation) θ4 are preferably greater than or equal to 90°, more preferably greater than or equal to 135°, and even more preferably greater than or equal to 180°. In FIG. 1C, the angle (angle of elevation) θ2 is approximately 115°, and the angle (angle of elevation) θ4 is approximately 115°. Although not illustrated, the left camera 80L and the right camera 80R are configured such that the lower boundary of the imaging range of each of the left camera 80L and the right camera 80R forms an angle of depression of 55° or more with respect to the virtual plane that is perpendicular to the turning axis K. Similarly, the upper left camera 80UL and the upper right camera 80UR are configured such that the upper boundary of the imaging range of each of the upper left camera 80UL and the upper right camera 80UR forms an angle of elevation of 90° or more with respect to the virtual plane that is perpendicular to the turning axis K.

Accordingly, with the upper front camera 80UF, the shovel 100 can detect an object present in a space above the cabin 10. Further, with the upper rear camera 80UB, the shovel 100 can detect an object present in a space above an engine hood. Further, with the upper left camera 80UL or the upper right camera 80UR, the shovel 100 can detect an object present in a space above the upper turning body 3. In this manner, with the upper rear camera 80UB, the upper front camera 80UF, the upper left camera 80UL, or the upper right camera 80UR, the shovel 100 can detect an object present in a space above the shovel 100.

In FIG. 1D, an area R3 represents a range in which the imaging range of the front camera 80F overlaps the imaging range of the left camera 80L. An area R4 represents a range in which the imaging range of the left camera 80L overlaps the imaging range of the rear camera 80B. An area R5 represents a range in which the imaging range of the rear camera 80B overlaps the imaging range of the right camera 80R. An area R6 represents a range in which the imaging range of the right camera 80R overlaps the imaging range of the front camera 80F. That is, the front camera 80F and the left camera 80L are arranged such that the imaging ranges of the front camera 80F and the left camera 80L partially overlap in the horizontal direction. The left camera 80L and the rear camera 80B are arranged such that the imaging ranges of the left camera 80L and the rear camera 80B partially overlap in the horizontal direction. The rear camera 80B and the right camera 80R are arranged such that the imaging ranges of the rear camera 80B and the right camera 80R partially overlap in the horizontal direction. The right camera 80R and the front camera 80F are arranged such that the imaging ranges of the right camera 80R and the front camera 80F partially overlap in the horizontal direction. Further, although not illustrated, the upper front camera 80UF and the upper left camera 80UL are arranged such that the imaging ranges of the upper front camera 80UF and the upper left camera 80UL partially overlap in the horizontal direction. In addition, the upper left camera 80UL and the upper rear camera 80UB are arranged such that the imaging ranges of the upper left camera 80UL and the upper rear camera 80UB partially overlap in the horizontal direction. In addition, the upper rear camera 80UB and the upper right camera 80UR are arranged such that the imaging ranges of the upper rear camera 80UB and the upper right camera 80UR partially overlap in the horizontal direction. In addition, the upper right camera 80UR and the upper front camera 80UF are arranged such that the imaging ranges of the upper right camera 80UR and the upper front camera 80UF partially overlap in the horizontal direction.

With the above-described arrangements, for example, the upper front camera 80UF can capture an image of an object present in a space where the end of the boom 4 is located and in the vicinity of the end of the boom 4 when the boom 4 is raised most. Accordingly, the controller 30 can use the image captured by the upper front camera 80UF to prevent the end of the boom 4 from contacting an overhead power line installed above the shovel 100.

The upper front camera 80UF may be attached to the cabin 10, such that the arm 5 and bucket 6 are within the imaging range of the upper front camera 80UF even when at least one of the arm 5 and bucket 6 is rotated while the boom 4 is raised most. In this case, even when at least one of the arm 5 and the bucket 6 is opened to the maximum while the boom 4 is raised most, the controller 30 can determine whether there is a possibility that a surrounding object may contact the excavation attachment AT.

The object detector 70 may be arranged in a similar manner to the image capturing device 80. That is, the rear sensor 70B and the upper rear sensor 70UB may be arranged such that monitoring ranges (detection ranges) of the rear sensor 70B and the upper rear sensor 70UB partially overlap in the vertical direction. Further, the front sensor 70F and the upper front sensor 70UF may be arranged such that detection ranges of the front sensor 70F and the upper front sensor 70UF partially overlap in the vertical direction. Further, the left sensor 70L and the upper left sensor 70UL may be arranged such that detection ranges of the left sensor 70L and the upper left sensor 70UL partially overlap in the vertical direction. Further, the right sensor 70R and the upper right sensor 70UR may be arranged such that the right sensor 70R and the upper right sensor 70UR partially overlap in the vertical direction.

The front sensor 70F and the left sensor 70L may be arranged such that the front sensor 70F and the left sensor 70L partially overlap in the horizontal direction. Further, the left sensor 70L and the rear sensor 70B may be arranged such that the left sensor 70L and the rear sensor 70B partially overlap in the horizontal direction. Further, the rear sensor 70B and the right sensor 70R may be arranged such that detection ranges of the rear sensor 70B and the right sensor 70R may partially overlap in the horizontal direction. Further, the right sensor 70R and the front sensor 70F may be arranged such that the right sensor 70R and the front sensor 70F partially overlap in the horizontal direction.

The upper front sensor 70UF and the upper left sensor 70UL may be arranged such that the upper front sensor 70UF and the upper left sensor 70UL partially overlap in the horizontal direction. Further, the upper left sensor 70UL and the upper rear sensor 70UB may be arranged such that the upper left sensor 70UL and the upper rear sensor 70UB partially overlap in the horizontal direction. Further, the upper rear sensor 70UB and the upper right sensor 70UR may be arranged such that the upper rear sensor 70UB and the upper right sensor 70UR partially overlap in the horizontal direction. Further, the upper right sensor 70UR and the upper front sensor 70UF may be arranged such that the upper right sensor 70UR and the upper front sensor 70UF partially overlap in the horizontal direction.

The rear sensor 70B, the front sensor 70F, the left sensor 70L, and the right sensor 70R may be configured such that the optical axis of each of the rear sensor 70B, the front sensor 70F, the left sensor 70L, and the right sensor 70R forms an angle of depression with respect to the virtual plane that is perpendicular to the turning axis K. The upper rear sensor 90UB, the upper front sensor 90UF, the upper left sensor 70UL, and the upper right sensor 70UR may be configured such that the optical axis of each of the upper rear sensor 70UB, the upper front sensor 70UF, the upper left sensor 70UL, and the upper right sensor 70UR forms an angle of elevation with respect to the virtual plane that is perpendicular to the turning axis K.

The rear sensor 70B, the front sensor 70F, the left sensor 70L, and the right sensor 70R may be configured such that the lower boundary of the detection range of each of the rear sensor 70B, the front sensor 70F, the left sensor 70L, and the right sensor 70R may form an angle of depression with respect to the virtual plane that is perpendicular to the turning axis K. The upper rear sensor 70UB, the upper front sensor 70UF, the upper left sensor 70UL, and the upper right sensor 70UR may be configured such that the upper boundary of the detection range of each of the upper rear sensor 70UB, the upper front sensor 70UF, the upper left sensor 70UL, and the upper right sensor 70UR forms an angle of elevation with respect to the virtual plane that is perpendicular to the turning axis K.

In the present embodiment, the rear camera 80B is placed next to the rear sensor 70B. The front camera 80F is placed next to the front sensor 90F. The left camera 80L is placed next to the left sensor 70L. The right camera 80R is placed next to the right sensor 70R. Further, the upper rear camera 80UB is placed next to the upper rear sensor 70UB. The upper front camera 80UF is placed next to the upper front sensor 70UF. The upper left camera 80UL is placed next to the upper left sensor 70UL. The upper right camera 80UR is placed next to the upper right sensor 70UR.

In the present embodiment, the image capturing device 80 and the object detector 70 are attached to the upper turning body 3 so as not to project outward from the outline of the upper turning body 3 when viewed from the top as illustrated in FIG. 1D. However, one of the image capturing device 80 and the object detector 70 may be attached to the upper turning body 3 so as to project outward from the outline of the upper turning body 3 when viewed from the top.

The upper rear camera 80UB is not required to be provided, or may be integrated with the rear camera 80B. The rear camera 80B, with which the upper rear camera 80UB is integrated, may be configured to cover a larger imaging range to include the imaging range of the upper rear camera 80UB. The same applies to the upper front camera 80UF, the upper left camera 80UL, and the upper right camera 80UR. Further, the upper rear sensor 70UB is not required to be provided, or may be integrated with the rear sensor 70B. The same applies to the upper front sensor 70UF, the upper left sensor 70UL, and the upper right sensor 70UR. Further, at least two of the upper rear camera 80UB, the upper front camera 80UF, the upper left camera 80UL, and the upper right camera 80UR may be integrated into one or more omnidirectional cameras or hemispherical cameras.

An image captured by the image capturing device 80 is displayed on the display device D1. The image capturing device 80 may be configured to be able to display a viewpoint change image such as an overhead view image on the display device D1. For example, an overhead view image is generated by combining respective output images of the rear camera 80B, the left camera 80L, and the right camera 80R.

The body tilt sensor S4 is configured to detect the inclination of the upper turning body 3 relative to a predetermined plane. In the present embodiment, the body tilt sensor S4 is an acceleration sensor that detects the tilt angle of the upper turning body 3 around its longitudinal axis and the tilt angle of the upper turning body 3 around its lateral axis relative to a horizontal plane. For example, the longitudinal axis and the lateral axis of the upper turning body 3 are perpendicular to each other and pass the shovel center point that is a point on the turning axis of the shovel PS.

The turning angular velocity sensor S5 is configured to detect the turning angular velocity of the upper turning body 3. In the present embodiment, the turning angular velocity sensor S5 is a gyroscope. However, the turning angular velocity sensor S5 may be a resolver, a rotary encoder, or the like. The turning angular velocity sensor S5 may also detect a turning speed. The turning speed may be calculated from a turning angular velocity.

In the following, at least one of the boom angle sensor S1, the arm angle sensor S2, the bucket angle sensor S3, the body tilt sensor S4, and the turning angular velocity sensor S5 may also be referred to as an orientation detector.

The display device D1 is configured to display various information. The audio output device D2 is configured to output audio. The operation device 26 is a device used by the operator to operate actuators. The actuators include at least one of a hydraulic actuator and an electric actuator.

The controller 30 is a control device for controlling the shovel 100. In the present embodiment, the controller 30 is configured by a computer including a (central processing unit) CPU, a random-access memory (RAM), a non-volatile random-access memory (NVRAM), and a read-only memory (ROM). The controller 30 reads programs corresponding to functions from the ROM, loads the programs into the RAM, and causes the CPU to execute corresponding processes. Examples of the functions include a machine guidance function that provides the operator with guidance (directions) on manually operating the shovel 100 and a machine control function that automatically assists the operator in manually operating the shovel 100.

Figure 2:
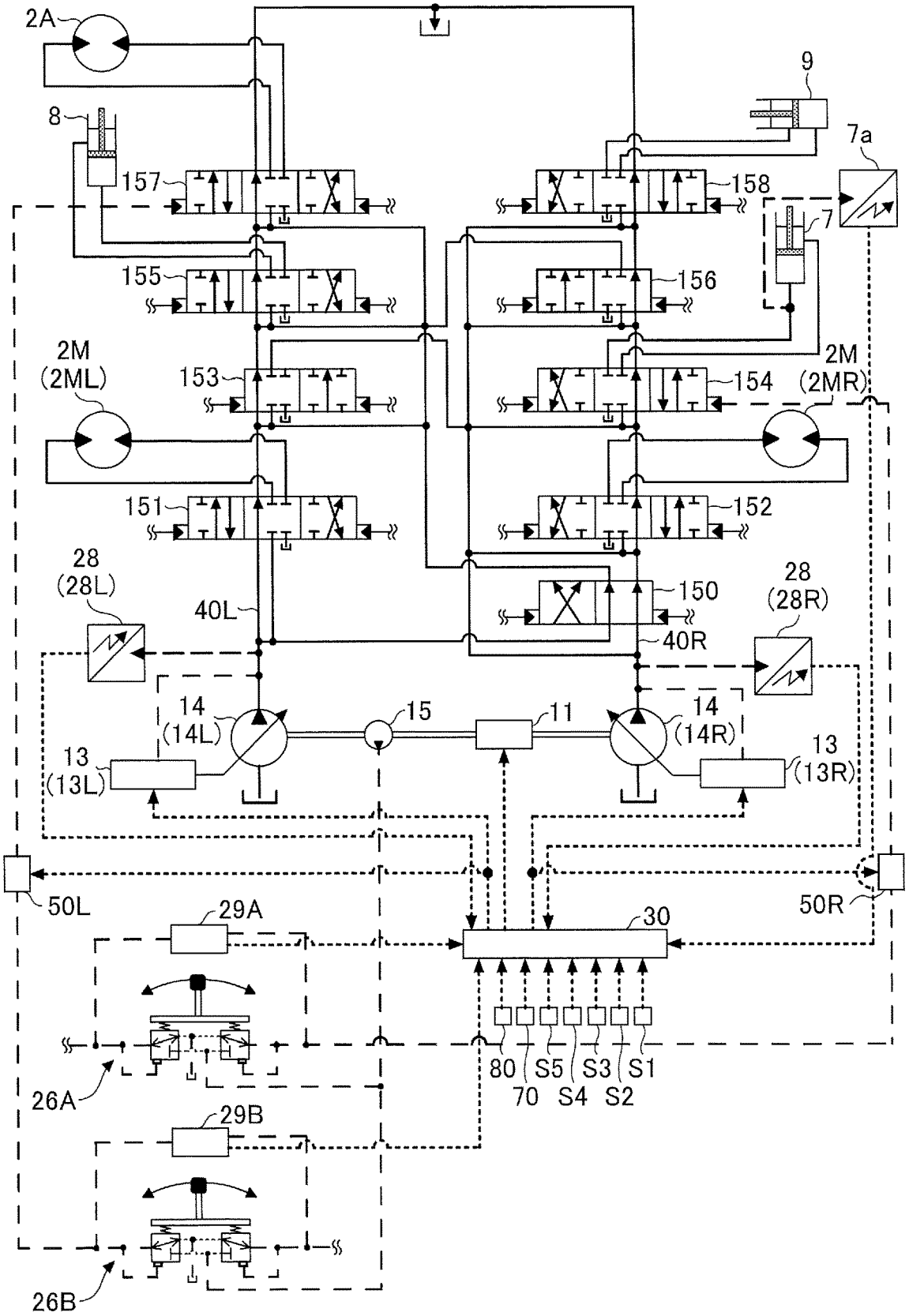
FIG. 2 is a diagram illustrating an example configuration of a hydraulic system installed in the shovel of FIG. 1A.

FIG. 2 is a diagram illustrating an example configuration of a hydraulic system installed in the shovel 100. In FIG. 2, a mechanical power transmission system, a hydraulic oil line, a pilot line, and an electrical control system are indicated by a double line, a solid line, a dashed line, and a dotted line, respectively.

The hydraulic system circulates hydraulic oil from a main pump 14, serving as a hydraulic pump and driven by the engine 11, to a hydraulic oil tank via a center bypass conduit 40. The main pump 14 includes a left main pump 14L and a right main pump 14R. The center bypass conduit 40 includes a left center bypass conduit 40L and a right center bypass conduit 40R.

The left center bypass conduit 40L is a hydraulic oil line that passes through control valves 151, 153, 155, and 157 placed in a control valve. The right center bypass conduit 40R is a hydraulic oil line that passes through the control valves 150, 152, 154, 156, and 158 placed in the control valve.

The control valve 150 is a straight travel valve. The control valve 151 is a spool valve that switches the flow of hydraulic oil in order to supply hydraulic oil discharged by the left main pump 14L to the left traveling hydraulic motor 2ML, and to discharge hydraulic oil in the left traveling hydraulic motor 2ML into the hydraulic oil tank. The control valve 152 is a spool valve that switches the flow of hydraulic oil in order to supply hydraulic oil discharged by the right main pump 14R to the right traveling hydraulic motor 2MR, and to discharge hydraulic oil in the right traveling hydraulic motor 2MR into the hydraulic oil tank.

The control valve 153 is a spool valve that switches the flow of hydraulic oil in order to supply hydraulic oil discharged by the left main pump 14L to the boom cylinder 7. The control valve 154 is a spool valve that switches the flow of hydraulic oil in order to supply hydraulic oil discharged by the right main pump 14R to the boom cylinder 7, and to discharge hydraulic oil in the boom cylinder 7 into the hydraulic oil tank.

The control valve 155 is a spool valve that switches the flow of hydraulic oil in order to supply hydraulic oil discharged by the left main pump 14L to the arm cylinder 8, and to discharge hydraulic oil in the arm cylinder 8 into the hydraulic oil tank. The control valve 156 is a spool valve that switches the flow of hydraulic oil in order to supply hydraulic oil discharged by the right main pump 14R to the arm cylinder 8.

The control valve 157 is a spool valve that switches the flow of hydraulic oil such that hydraulic oil discharged by the left main pump 14L circulates in the hydraulic motor 2A.

The control valve 158 is a spool valve that switches the flow of hydraulic oil in order to supply hydraulic oil discharged by the right main pump 14R to the bucket cylinder 9, and to discharge hydraulic oil in the bucket cylinder 9 into the hydraulic oil tank.

A regulator 13 controls the discharge quantity of the main pump 14 by adjusting the swash plate tilt angle of the main pump 14 in accordance with the discharge pressure of the main pump 14 (for example, by total horsepower control). In the example of FIG. 2, the regulator 13 includes a left regulator 13L corresponding to the left main pump 14L, and a right regulator 13R corresponding to the right main pump 14R.

A boom operating lever 26A is an operation device for raising or lowering the boom 4. The boom operating lever 26A uses hydraulic oil discharged by a pilot pump 15 to cause a control pressure corresponding to the lever operation amount to act on a left or a right pilot port of the control valve 154. As a result, the stroke of a spool in the control valve 154 is controlled, such that the flow rate of hydraulic oil supplied to the boom cylinder 7 is controlled. The same applies to the control valve 153. In FIG. 2, pilot lines that connect the boom operating lever 26A to the left pilot port of the control valve 153, the right pilot port of the control valve 153, and a left pilot port of the control valve 154 are not depicted for clarification purposes.

An operating pressure sensor 29A detects the details of the operator's operation of the boom operating lever 26A in the form of pressure, and outputs the detected value to the controller 30, which serves as the control device. Examples of the details of the operator's operation include the lever operation direction and the lever operation amount (the lever operation angle).

A turning operating lever 26B is an operation device that brings the turning mechanism 2 into operation by driving the turning hydraulic motor 2A. For example, the turning operating lever 26B uses hydraulic oil discharged by the pilot pump 15 to cause a control pressure corresponding to the lever operation amount to act on a left or a right pilot port of the control valve 157. As a result, the stroke of a spool in the control valve 157 is controlled, such that the flow rate of hydraulic oil supplied to the turning hydraulic motor 2A is controlled. The same applies to the control valve 153. In FIG. 2, a pilot line that connects the turning operating lever 26B to the right pilot port of the control valve 157 is not depicted for clarification purposes.

An operating pressure sensor 29B detects the details of the operator's operation of the turning operating lever 26B in the form of pressure, and outputs the detected value to the controller 30, which serves as the control device.

The shovel 100 includes traveling levers, traveling pedals, an arm operating lever, and a bucket operating lever (none of which is illustrated). The traveling levers, the traveling pedals, the arm operating lever, and the bucket operating lever (none of which is illustrated) are operation devices for causing the lower traveling body 1 to travel, opening or closing the arm 5, and open or close the bucket 6, respectively. Similar to the boom operating lever 26A, these operation devices use hydraulic oil discharged by the pilot pump 15 to cause a control pressure corresponding to the lever operation amount or the pedal operation amount to act on a left or a right pilot port of a corresponding control valve. Further, the details of the operator's operation of each of the operation devices is detected in the form of pressure by a corresponding operating pressure sensor, similar to the operating pressure sensor 29A. Each of the operating pressure sensors outputs a detected value to the controller 30.

The controller 30 receives the output of each of the boom angle sensor S1, the arm angle sensor S2, the bucket angle sensor S3, the operating pressure sensor 29A, the operating pressure sensor 29B, a boom cylinder pressure sensor 7*a*, a discharge pressure sensor 28, and a negative control pressure sensor (not illustrated), and appropriately outputs a control signal to the engine 11 and the regulator 13.

The controller 30 may control the turning operation of the upper turning body 3 by outputting a control signal to a pressure reducing valve 50L and adjusting a control pressure acting on the control valve 157. Further, the controller 30 may control the boom raising operation of the boom 4 by outputting a control signal to a pressure reducing valve 50R and adjusting a control pressure acting on the control valve 154. In FIG. 2, a configuration in which a control pressure acting on the left pilot port of the control valve 157 is depicted, and a configuration in which a control pressure acting on the right pilot port of the control valve 157 is not depicted for clarification purposes. In addition, in FIG. 2, a configuration in which a control pressure acting on the right pilot port of the control valve 154 is depicted, and a configuration in which a control pressure acting on the left pilot port of the control valve 154 is not depicted for clarification purposes Therefore, the controller 30 can adjust a control pressure related to the control valve 157 through the pressure reducing valve 50L, based on the relative positional relationship between the bucket 6 and a dump truck. Further, the controller 30 can adjust a control pressure related to the control valve 154 through the pressure reducing valve 50R, based on the relative positional relationship between the bucket 6 and the dump truck. Accordingly, a boom raising and turning operation by lever operations can be properly assisted. The pressure reducing valve 50L and the pressure reducing valve 50R may be solenoid proportional valves.

Figure 3A:
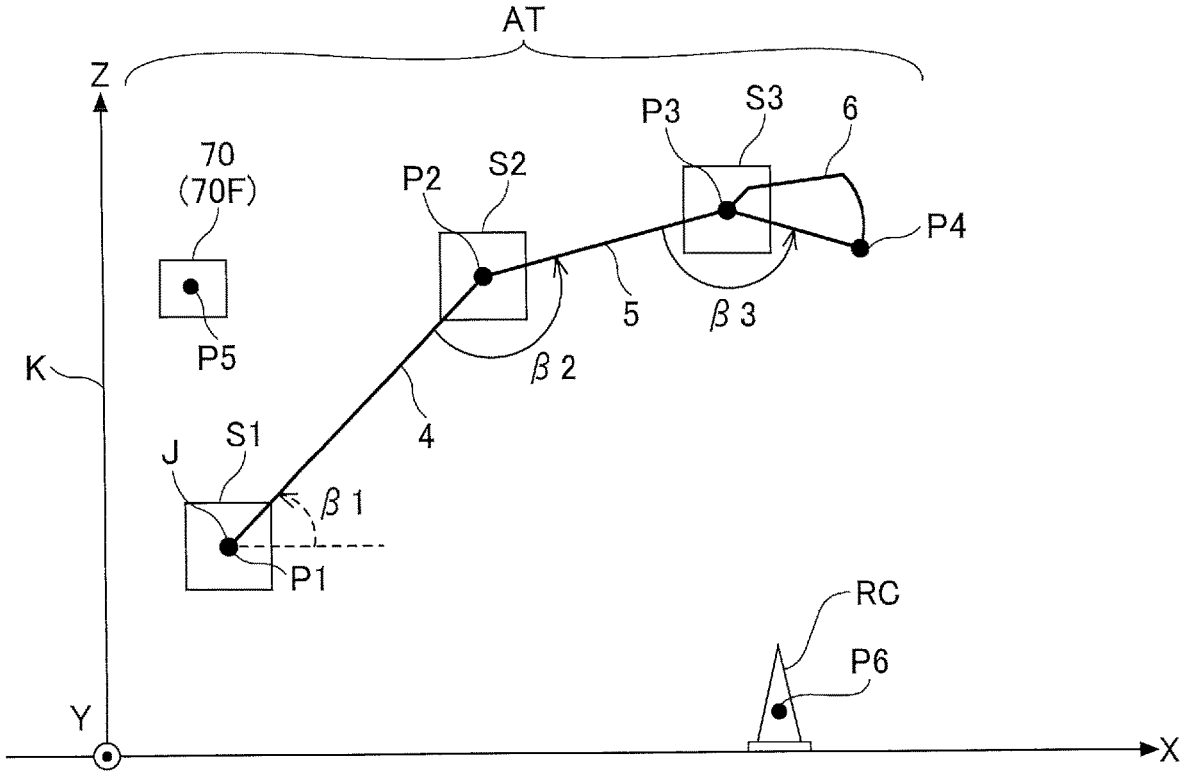
FIG. 3A is a diagram illustrating the positional relationship between components constituting the shovel.
Figure 3B:
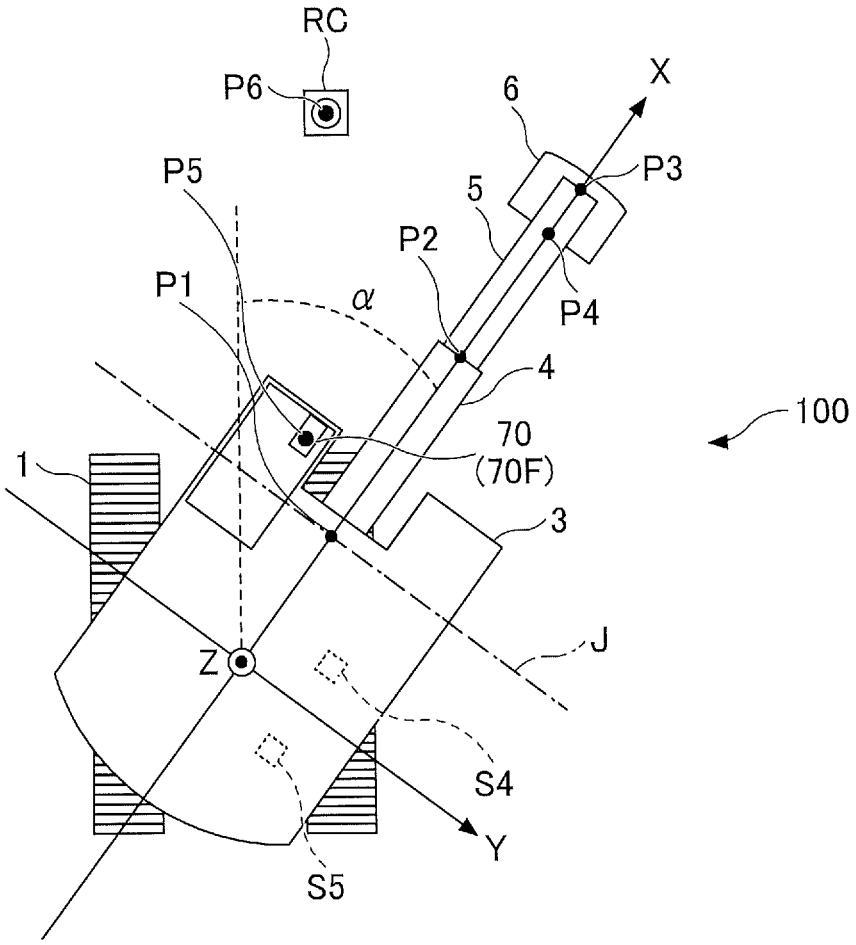
FIG. 3B is a diagram illustrating the positional relationship between components constituting the shovel.

Next, the function of identifying the orientation of the shovel 100 by the controller 30 will be described with reference to FIG. 3A and FIG. 3B. FIG. 3A and FIG. 3B are drawings illustrating the positional relationship between components constituting the shovel 100. Specifically, FIG. 3A is a right side view of the shovel 100, and FIG. 3B is a top view of the shovel 100. FIG. 3A depicts a simplified model of the excavation attachment AT, in which the components of the shovel 100 other than the excavation attachment AT are not depicted for clarification purposes.

As illustrated in FIG. 3A, the boom 4 is configured to vertically pivot about a pivot axis J, parallel to the Y-axis, relative to the upper turning body 3. The arm 5 is attached to the end of the boom 4. The bucket 6 is attached to the end of the arm 5. The boom angle sensor S1 is attached to a coupling portion of the upper turning body 3 and the boom 4. The coupling portion of the upper turning body 3 and the boom 4 is indicated by a point P1. The arm angle sensor S2 is attached to a coupling portion of the boom 4 and the arm 5. The coupling portion of the boom 4 and the arm 5 is indicated by a point P2. The bucket angle sensor S3 is attached to a coupling portion of the arm 5 and the bucket 6. The coupling portion of the arm 5 and the bucket 6 is indicated by a point P3. A point P4 indicates the position of the end (tip) of the bucket 6. A point P5 indicates the position of the front sensor 70F. A point P6 indicates the position of a road cone RC.

The boom angle sensor S1 measures the boom angle β1 between the longitudinal direction of the boom 4 and a reference horizontal plane. The reference horizontal plane may be the ground surface contacted by the shovel 100. The arm angle sensor S2 measures the arm angle β2 between the longitudinal direction of the boom 4 and the longitudinal direction of the arm 5. The bucket angle sensor S3 measures the bucket angle β3 between the longitudinal direction of the arm 5 and the longitudinal direction of the bucket 6. The longitudinal direction of the boom 4 refers to a direction of a straight line passing through the point P1 and the point P2 in a reference vertical plane (XZ plane) perpendicular to the pivot axis J. The longitudinal direction of the arm 5 refers to a direction of a straight line passing through the point P2 and the point P3 in the reference vertical plane. The longitudinal direction of the bucket 6 refers to a direction of a straight line passing through the point P3 and the point P4 in the reference vertical plane. The pivot axis J is located at a position away from a turning axis K (Z-axis). The pivot axis J may be located such that the turning axis K and the pivot axis J cross each other.

Further, as illustrated in FIG. 3B, the upper turning body 3 is configured to horizontally pivot about the turning axis K (Z-axis) relative to the lower traveling body 1. The body tilt sensor S4 and the turning angular velocity sensor S5 are attached to the upper turning body 3.

The body tilt sensor S4 measures an angle between the lateral axis (Y-axis) of the upper turning body 3 and the reference horizontal plane, and an angle between the longitudinal axis (X-axis) of the upper turning body 3 and the reference horizontal plane. The turning angular velocity sensor S5 measures an angle α between the longitudinal axis of the lower traveling body 1 and the longitudinal axis (X-axis) of the upper turning body 3. The longitudinal axis of the lower traveling body 1 means the extension direction of the crawlers 1C.

For example, the controller 30 can determine the relative position of the point P1 with respect to the origin O based on the output of each of the body tilt sensor S4 and the turning angular velocity sensor S5, because the point P1 is located at a fixed position on the upper turning body 3. The origin O may be the intersection of the reference horizontal plane and the Z-axis. Further, the controller 30 can determine the relative positions of the point P2 to P4 with respect to the point P1 based on the output of each of the boom angle sensor S1, the arm angle sensor S2, and the bucket angle sensor S3. Similarly, the controller 30 can determine the relative position of any portion of the excavation attachment AT, such as the edge of the back surface of the bucket 6, with respect to the point P1.

Further, the controller 30 can determine the relative position of the point P5 with respect to the origin O based on the relative position of the point P1 with respect to the origin O. This is because the front sensor 70F is fixed to the upper surface of the cabin 10. That is, the positional relationship between the point P1 and the point P5 does not change even when the excavation attachment AT is moved or the upper turning body 3 is turned.

Further, the controller 30 can determine the relative position of the point P6 with respect to the origin O based on the relative position of the point P5 with respect to the origin O. This is because the front sensor 70F is configured to derive the distance between the point P5 and each point on the road cone RC and the direction of the road cone RC. That is, the relative position of the point P6 with respect to the point P5 can be derived. Accordingly, the controller 30 can derive the orientation of the excavation attachment AT, the position of the tip of the bucket 6, and the position of an object located in the vicinity of the shovel 100, based on the output from each of the boom angle sensor S1, the arm angle sensor S2, the bucket angle sensor S3, the body tilt sensor S4, the turning angular velocity sensor S5, and the object detector 70.

Figure 4:
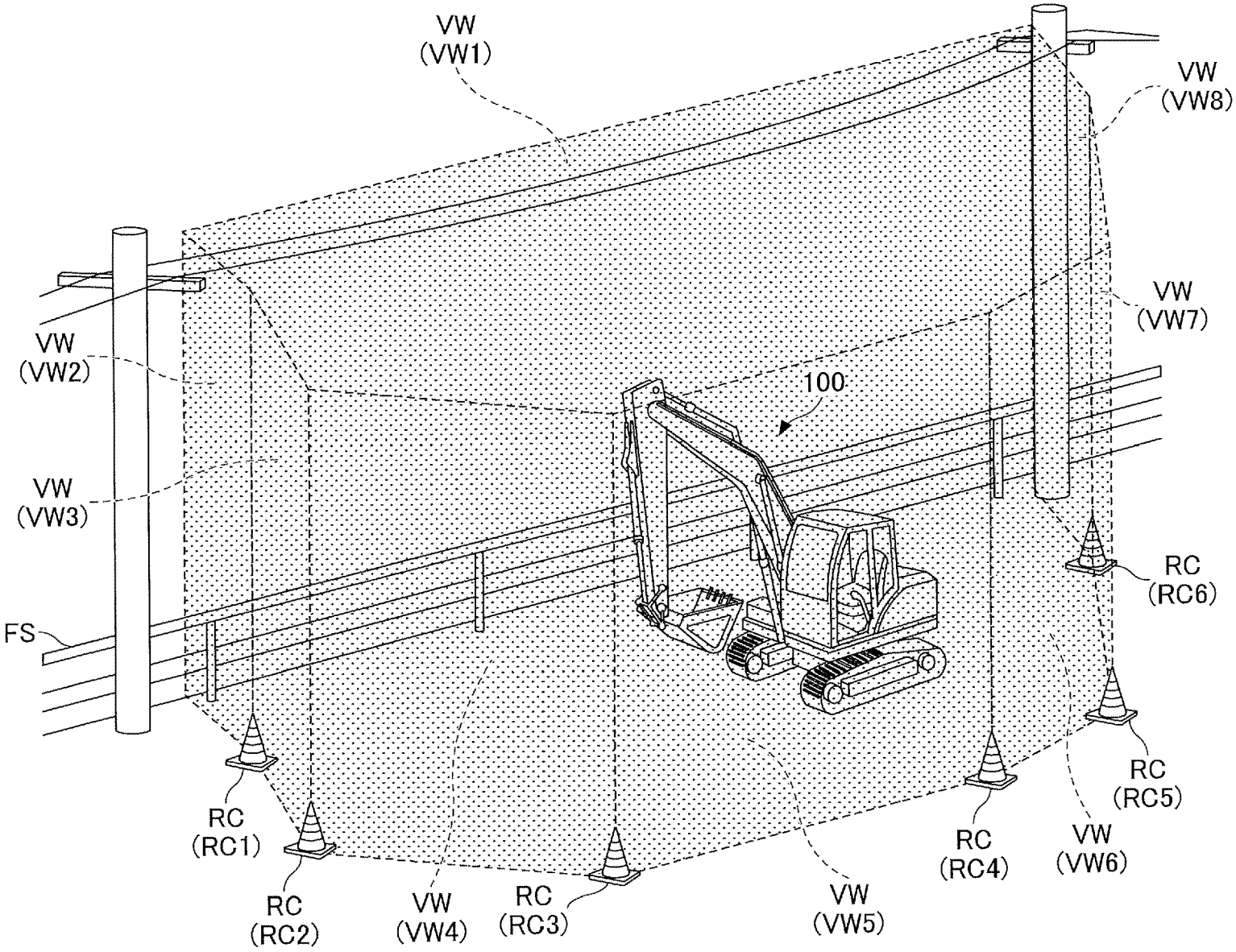
FIG. 4 is a perspective view of the shovel.

Next, an example of the function of restricting the movement of the shovel 100 (hereinafter referred to as a "restriction function") by the controller 30 will be described with reference to FIG. 4. FIG. 4 is a perspective view of the shovel 100 located on a road DW. FIG. 4 depicts a state in which the working range of the shovel 100 is surrounded by six road cones RC and a fence FS. The road DW and a sidewalk SW are separated by a fence FS.

The controller 30 identifies the position of each of the six road cones RC and the position of the fence FS, based on the output of the LIDAR serving as the object detector 70, which is an example of the surroundings monitoring device.

The position (coordinates) of the shovel 100 is derived based on the output of a positioning device (such as a GNSS receiver) mounted on the upper turning body 3. The coordinates of the shovel 100 may be coordinates in a reference coordinate system used for a construction plan drawing such as design data. The reference coordinate system may be the World Geodetic System. The World Geodetic System is a three-dimensional orthogonal XYZ coordinate system in which the origin is at the center of gravity of the earth, the X-axis passes through the intersection of the Greenwich meridian and the equator, the Y-axis passes through 90 degrees east longitude, and the Z-axis passes through the north pole.

Further, the controller 30 can calculate the coordinates of each object detected by the object detector 70 (e.g., each object subjected to detection by the object detector 70) in the reference coordinate system. Therefore, the controller 30 can understand the positional relationship between the shovel 100 and each object such as an obstacle, and can associate the position of each of the objects with a construction plan drawing. Further, in the construction plan drawing, the controller 30 can input not only a target construction surface (such as the ground surface to be excavated), but also the positional relationship between the objects and the target construction surface. Accordingly, when displaying the construction plan drawing, the controller 30 can also display the position of each of the objects with respect to the target construction surface.

The controller 30 can calculate the regularity of the arrangement of objects detected by the object detector 70. For example, the regularity may be the continuity of the arrangement of objects. For example, the regularity may be at least one of linearity, symmetry, and repeatability, rather than continuity.

Specifically, the controller 30 identifies that the six road cones RC are continuously arranged. Further, the controller 30 identifies that a closed working space is formed by the six road cones RC and the fence FS, which serves as a road boundary fence. Further, the controller 30 may identify that a closed working space is formed by the six road cones RC, the fence FS, and utility poles.

In this case, the controller 30 sets virtual walls VW, based on the positions of the respective six road cones RC and the position of the fence FS. The virtual walls VW are walls that separate the working range of the shovel 100.

The virtual walls VW may be superimposed on an arrangement drawing or a construction plan drawing, and displayed on the display device D1. For example, after the operator checks images of the virtual walls VW displayed on the display device D1 by the controller 30, the virtual walls VW may be set by the operator pressing a setting button. Alternatively, the virtual walls VW may be automatically set when the controller 30 identifies the closed working space. Further, information related to objects such as utility poles and a fence FS that can be identified beforehand may be preliminarily set as data related to a construction plan drawing. In this case, the controller 30 may preliminarily associate the position of a target construction surface with the position of each of the objects when the construction plan drawing is acquired. At the time of construction, the controller 30 can generate virtual walls VW based on the positional relationship between the target construction surface and each of the objects. Further, the controller 30 may generate virtual walls VW by associating the arrangement of road cones RC, whose positional relationship changes depending on the construction situation, with the arrangement of preliminarily set objects.

The controller 30 is configured to restrict the movement of an actuator such that the shovel 100 does not cross the virtual walls VW. Specifically, the controller 30 is configured to identify the surrounding environment as if there were actual walls at positions corresponding to the positions of the virtual walls VW, and restrict the movement of the shovel 100 such that the shovel 100 does not contact the walls, which do not actually exist. The virtual walls VW may function as virtual protective walls that prevent contact between the shovel 100 and objects located on the outside of the virtual walls VW.

Specifically, the controller 30 sets a first virtual wall VW1 along the fence FS, such that a part of the shovel 100, such as the crawlers 1C, the excavation attachment AT, or the counterweight, does not extend over the fence FS to the sidewalk SW. Further, the controller 30 sets a second virtual wall VW2 between the fence FS and a first road cone RC1, sets a third virtual wall VW3 between the first road cone RC1 and a second road cone RC2, sets a fourth virtual wall VW4 between the second road cone RC2 and a third road cone RC3, sets a fifth virtual wall VW5 between the third road cone RC3 and a fourth road cone RC4, sets a sixth virtual wall VW6 between the fourth road cone RC4 and a fifth road cone RC5, sets a seventh virtual wall VW7 between the fifth road cone RC5 and a sixth road cone RC6, and sets an eighth virtual wall VW8 between the sixth road cone RC6 and the fence FS. Accordingly, it is possible to prevent a part of the shovel 100 from extending outward beyond a boundary defined by the road cones RC.

Note that a cone bar may be placed between two neighboring road cones RC. In this case, the controller 30 may set a virtual wall VW along the cone bar detected by the LIDAR.

In the present embodiment, the controller 30 sets the virtual walls VW, such that the virtual walls VW extend vertically upward from the ground and are higher than the highest reachable point of the excavation attachment AT. However, the height of the virtual walls VW may be lower than the highest reachable point of the excavation attachment AT. Alternatively, the virtual walls VW may be set to extend into the ground.

For example, if the distance between a virtual wall VW and a part of the shovel 100 (such as the counterweight) falls below a predetermined value during the turning operation of the upper turning body 3, the controller 30 may slow or stop the turning operation by outputting a control signal to the pressure reducing valve 50L and adjusting a control pressure acting on the control valve 157. Alternatively, for example, if the distance between a virtual wall VW and a part of the shovel 100 (such as the end of the boom 4) falls below the predetermined value during a boom lowering operation, the controller 30 may slow or stop the boom lowering operation by outputting a control signal to the pressure reducing valve 50R and adjusting a control pressure acting on the control valve 154. Further, if the distance between a virtual wall VW and a part of the shovel 100 falls below the predetermined value, the controller 30 may output an alarm. The alarm may be a visual alarm or an aural alarm.

With the above-described configuration, the controller 30 can prevent the entry of a part of the shovel 100 into a prohibited space during the operation of the shovel 100. The prohibited space is a space where the entry of the shovel 100 is prohibited. The prohibited space includes at least one of a space on the sidewalk SW side and a space on the outside of a boundary defined by a plurality of road cones RC (on the side opposite to the shovel 100).

Figure 5:
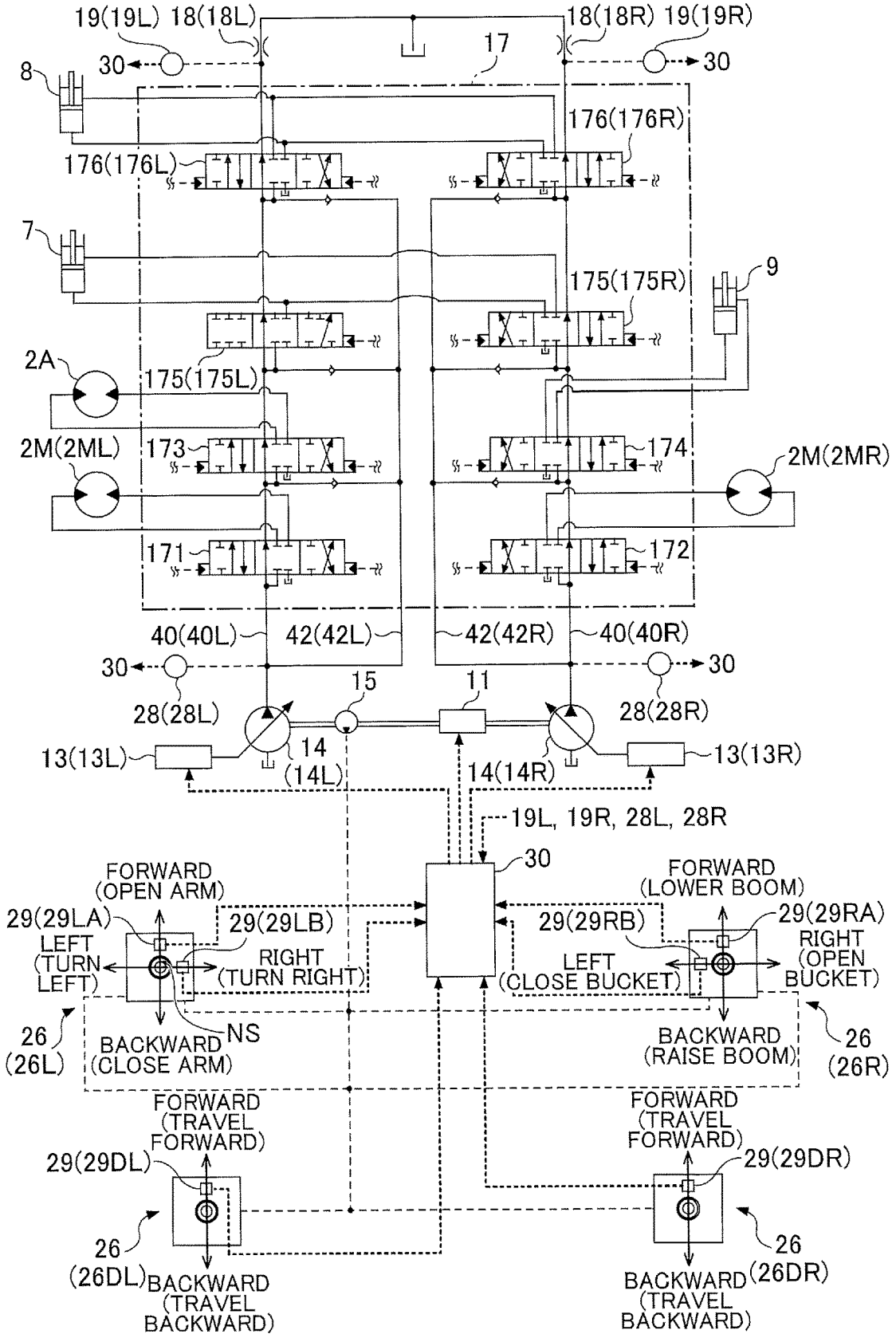
FIG. 5 is a diagram illustrating another example configuration of a hydraulic system installed in the shovel of FIG. 1A.

Next, another example configuration of a hydraulic system installed in the shovel 100 will be described with reference to FIG. 5. FIG. 5 is a diagram illustrating another example configuration of a hydraulic system installed in the shovel 100. Similar to FIG. 2, in FIG. 5, a mechanical power transmission system, a hydraulic oil line, a pilot line, and an electrical control system are indicated by a double line, a solid line, a dashed line, and a dotted line, respectively.

Similar to the hydraulic system of FIG. 2, the hydraulic system of FIG. 5 mainly includes an engine 11, a regulator 13, a main pump 14, a pilot pump 15, a control valve 17, an operation device 26, a discharge pressure sensor 28, an operating pressure sensor 29, and a controller 30.

In FIG. 5, the hydraulic system circulates hydraulic oil from the main pump 14 driven by the engine 11 to a hydraulic oil tank via a center bypass conduit 40 or a parallel conduit 42

The engine 11 is a drive source of the shovel 100. In the present embodiment, the engine 11 is, for example, a diesel engine that operates so as to maintain a predetermined rotational speed. The output shaft of the engine 11 is coupled to the input shafts of the main pump 14 and the pilot pump 15.

The main pump 14 supplies hydraulic oil to the control valve 17 via a hydraulic oil line. In the present embodiment, the main pump 14 is a swash plate variable displacement hydraulic pump.

The regulator 13 controls the discharge quantity of the main pump 14. In the present embodiment, the regulator 13 controls the discharge quantity of the main pump 14 by adjusting the swash plate tilt angle of the main pump 14 in response to a control command from the controller 30.

The pilot pump 15 is configured so as to supply hydraulic oil to hydraulic control devices including the operation device 26 via a pilot line. In the present embodiment, the pilot pump 15 is a fixed displacement hydraulic pump. However, the pilot pump 15 may be omitted. In this case, the function carried by the pilot pump 15 may be implemented by the main pump 14. That is, the main pump 14 may have a function of supplying hydraulic oil to the operation device 26 after reducing the pressure of the hydraulic oil with a throttle or the like, in addition to a function of supplying hydraulic oil to the control valve 17.

The control valve 17 is a hydraulic control unit that controls the hydraulic system installed in the shovel 100. In the present embodiment, the control valve 17 includes control valves 171 through 176. The control valve 175 includes a control valve 175L and a control valve 175R, and the control valve 176 includes a control valve 176L and a control valve 176R. The control valve 17 can selectively supply hydraulic oil discharged by the main pump 14 to one or more hydraulic actuators through the control valves 171 through 176. The control valves 171 through 176 control the flow rate of hydraulic oil flowing from the main pump 14 to the hydraulic actuators and the flow rate of hydraulic oil flowing from the hydraulic actuators to the hydraulic oil tank. The hydraulic actuators include the boom cylinder 7, the arm cylinder 8, the bucket cylinder 9, the left traveling hydraulic motor 2ML, the right traveling hydraulic motor 2MR, and the turning hydraulic motor 2A.

The operation device 26 is a device used by the operator to operate actuators. The actuators include at least one of a hydraulic actuator and an electric actuator. In the present embodiment, the operation device 26 supplies hydraulic oil discharged by the pilot pump 15 to a pilot port of a corresponding control valve in the control valve 17 through a pilot line. The pressure of hydraulic oil supplied to each pilot port (pilot pressure) is a pressure corresponding to the direction of operation and the amount of operation of the operation device 26 for a corresponding hydraulic actuator. However, the operation device 26 may be of an electrical control type, instead of the above-described pilot pressure type. In this case, the control valves in the control valve 17 may be electromagnetic solenoid spool valves.

The discharge pressure sensor 28 detects the discharge pressure of the main pump 14. In the present embodiment, the discharge pressure sensor 28 outputs the detected value to the controller 30.

The operating pressure sensor 29 detects the details of the operator's operation of the operation device 26. In the present embodiment, the operating pressure sensor 29 detects the direction of operation and the amount of operation of the operation device 26 corresponding to each actuator in the form of pressure (operating pressure), and outputs the detected value to the controller 30. The details of the operation of the operation device 26 may be detected using a sensor other than the operating pressure sensor.

The main pump 14 includes a left main pump 14L and a right main pump 14R. The left main pump 14L circulates hydraulic oil to the hydraulic oil tank through a left center bypass conduit 40L or a left parallel conduit 42L. The right main pump 14R circulates hydraulic oil to the hydraulic oil tank through a right center bypass conduit 40R or a right parallel conduit 42R.

The left center bypass conduit 40L is a hydraulic oil line that passes through the control valves 171, 173, 175L and 176L placed in the control valve 17. The right center bypass conduit 40R is a hydraulic oil line that passes through the control valves 172, 174, 175R and 176R placed in the control valve 17.

The control valve 171 is a spool valve that switches the flow of hydraulic oil in order to supply hydraulic oil discharged by the left main pump 14L to the left traveling hydraulic motor 2ML and to discharge hydraulic oil discharged by the left traveling hydraulic motor 2ML into the hydraulic oil tank.

The control valve 172 is a spool valve that switches the flow of hydraulic oil in order to supply hydraulic oil discharged by the right main pump 14R to the right traveling hydraulic motor 2MR and to discharge hydraulic oil discharged by the right traveling hydraulic motor 2MR into the hydraulic oil tank.

The control valve 173 is a spool valve that switches the flow of hydraulic oil in order to supply hydraulic oil discharged by the left main pump 14L to the turning hydraulic motor 2A and to discharge hydraulic oil discharged by the turning hydraulic motor 2A into the hydraulic oil tank.

The control valve 174 is a spool valve that switches the flow of hydraulic oil in order to supply hydraulic oil discharged by the right main pump 14R to the bucket cylinder 9 and to discharge hydraulic oil in the bucket cylinder 9 into the hydraulic oil tank.

The control valve 175L is a spool valve that switches the flow of hydraulic oil in order to supply hydraulic oil discharged by the left main pump 14L to the boom cylinder 7. The control valve 175R is a spool valve that switches the flow of hydraulic oil in order to supply hydraulic oil discharged by the right main pump 14R to the boom cylinder 7 and to discharge hydraulic oil in the boom cylinder 7 into the hydraulic oil tank.

The control valve 176L is a spool valve that switches the flow of hydraulic oil in order to supply hydraulic oil discharged by the left main pump 14L to the arm cylinder 8 and to discharge hydraulic oil in the arm cylinder 8 into the hydraulic oil tank.

The control valve 176R is a spool valve that switches the flow of hydraulic oil in order to supply hydraulic oil discharged by the right main pump 14R to the arm cylinder 8 and to discharge hydraulic oil in the arm cylinder 8 into the hydraulic oil tank.

The left parallel conduit 42L is a hydraulic oil line parallel to the left center bypass conduit 40L. When the flow of hydraulic oil through the left center bypass conduit 40L is restricted or blocked by any of the control valves 171, 173 and 175L, the left parallel conduit 42L can supply hydraulic oil to a control valve further downstream. The right parallel conduit 42R is a hydraulic oil line parallel to the right center bypass conduit 40R. When the flow of hydraulic oil through the right center bypass conduit 40R is restricted or blocked by any of the control valves 172, 174 and 175R, the right parallel conduit 42R can supply hydraulic oil to a control valve further downstream.

The regulator 13 includes a left regulator 13L and a right regulator 13R. The left regulator 13L controls the discharge quantity of the left main pump 14L by adjusting the swash plate tilt angle of the left main pump 14L in accordance with the discharge pressure of the left main pump 14L. Specifically, the left regulator 13L reduces the discharge quantity of the left main pump 14L by adjusting the swash plate tilt angle of the left main pump 14L in accordance with an increase in the discharge pressure of the left main pump 14L. The same applies to the right regulator 13R. With this configuration, it is possible to prevent the absorbed power of the main pump 14 expressed by the product of the discharge pressure and the discharge quantity from exceeding the output power of the engine 11.

The operation device 26 includes a left operating lever 26L, a right operating lever 26R, and a traveling lever 26D. The traveling lever 26D includes a left traveling lever 26DL and a right traveling lever 26DR.

The left operating lever 26L is used for a turning operation and to operate the arm 5. When operated forward or backward, the left operating lever 26L causes a control pressure corresponding to the lever operation amount to act on a pilot port of the control valve 176, using hydraulic oil discharged by the pilot pump 15. When operated rightward or leftward, the left operating lever 26L causes a control pressure corresponding to the lever operation amount to act on a pilot port of the control valve 173, using hydraulic oil discharged by the pilot pump 15.

Specifically, when operated in an arm closing direction, the left operating lever 26L causes hydraulic oil to act on the right pilot port of the control valve 176L, and causes hydraulic oil to act on the left pilot port of the control valve 176R. Further, when operated in an arm opening direction, the left operating lever 26L causes hydraulic oil to act on the left pilot port of the control valve 176L, and causes hydraulic oil to act on the right pilot port of the control valve 176R. Further, when operated in a left turning direction, the left operating lever 26L causes hydraulic oil to act on the left pilot port of the control valve 173. When operated in a right turning direction, the left operating lever 26L causes hydraulic oil to act on the right pilot port of the control valve 173.

The right operating lever 26R is used to operate the boom 4 and operate the bucket 6. When operated forward or backward, the right operating lever 26R causes a control pressure corresponding to the lever operation amount to act on a pilot port of the control valve 175, using hydraulic oil discharged by the pilot pump 15. When operated rightward or leftward, the right operating lever 26R causes a control pressure corresponding to the lever operation amount to act on a pilot port of the control valve 174, using hydraulic oil discharged by the pilot pump 15.

Specifically, when operated in a boom lowering direction, the right operating lever 26R causes hydraulic oil to act on the left pilot port of the control valve 175R. Further, when operated in a boom raising direction, the right operating lever 26R causes hydraulic oil to act on the right pilot port of the control valve 175L, and causes hydraulic oil to act on the left pilot port of the control valve 175R. Further, when operated in a bucket closing direction, the right operating lever 26R causes hydraulic oil to act on the right pilot port of the control valve 174. When operated in a bucket opening direction, the right operating lever 26R causes hydraulic oil to act on the left pilot port of the control valve 174.

The traveling lever 26D is used to operate the crawlers 1C. Specifically, the left traveling lever 26DL is used to operate the left crawler 1CL. The left traveling lever 26DL may be configured to operate together with a left traveling pedal. When operated forward or backward, the left traveling lever 26DL causes a control pressure corresponding to the lever operation amount to act on a pilot port of the control valve 171, using hydraulic oil discharged by the pilot pump 15. The right traveling lever 26DR is used to operate the right crawler 1CR. The right traveling lever 26DR may be configured to operate together with a right traveling pedal. When operated forward or backward, the right traveling lever 26DR causes a control pressure corresponding to the lever operation amount to act on a pilot port of the control valve 172, using hydraulic oil discharged by the pilot pump 15.

The discharge pressure sensor 28 includes a discharge pressure sensor 28L and a discharge pressure sensor 28R. The discharge pressure sensor 28L detects the discharge pressure of the left main pump 14L, and outputs the detected value to the controller 30. The same applies to the discharge pressure sensor 28R.

The operating pressure sensor 29 includes operating pressure sensors 29LA, 29LB, 29RA, 29RB, 29DL, and 29DR. The operating pressure sensor 29LA detects the details of the operator's forward or backward operation of the left operating lever 26L in the form of pressure, and outputs the detected value to the controller 30. Examples of the details of the operator's operation include the lever operation direction and the lever operation amount (the lever operation angle).

Likewise, the operating pressure sensor 29LB detects the details of the operator's rightward or leftward operation of the left operating lever 26L in the form of pressure, and outputs the detected value to the controller 30. The operating pressure sensor 29RA detects the details of the operator's forward or backward operation of the right operating lever 26R in the form of pressure, and outputs the detected value to the controller 30. The operating pressure sensor 29RB detects the details of the operator's rightward or leftward operation of the right operating lever 26R in the form of pressure, and outputs the detected value to the controller 30. The operating pressure sensor 29DL detects the details of the operator's forward or backward operation of the left traveling lever 26DL in the form of pressure, and outputs the detected value to the controller 30. The operating pressure sensor 29DR detects the details of the operator's forward or backward operation of the right traveling lever 26DR in the form of pressure, and outputs the detected value to the controller 30.

The controller 30 receives the output of the operating pressure sensor 29, and outputs a control command to the regulator 13 to change the discharge quantity of the main pump 14 as necessary. Furthermore, the controller 30 receives the output of a control pressure sensor 19 provided upstream of a throttle 18, and outputs a control command to the regulator 13 to change the discharge quantity of the main pump 14 as necessary. The throttle 18 includes a left throttle 18L and a right throttle 18R. The control pressure sensor 19 includes a left control pressure sensor 19L and a right control pressure sensor 19R.

In the left center bypass conduit 40L, the left throttle 18L is placed between the most downstream control valve 176L and the hydraulic oil tank. Therefore, the flow of hydraulic oil discharged by the left main pump 14L is restricted by the left throttle 18L. The left throttle 18L generates a control pressure for controlling the left regulator 13L. The left control pressure sensor 19L is a sensor that detects this control pressure and outputs the detected value to the controller 30. The controller 30 controls the discharge quantity of the left main pump 14L by adjusting the swash plate tilt angle of the left main pump 14L in accordance with the control pressure. The controller 30 decreases the discharge quantity of the left main pump 14L as the control pressure increases, and increases the discharge quantity of the left main pump 14L as the control pressure decreases. The discharge quantity of the right main pump 14R is controlled in the same manner.

Specifically, as illustrated in FIG. 5, in the standby state where none of the hydraulic actuators in the shovel 100 is in operation, hydraulic oil discharged by the left main pump 14L passes through the left center bypass conduit 40L and reaches the left throttle 18L. The flow of hydraulic oil discharged by the left main pump 14L increases the control pressure generated upstream of the left throttle 18L. As a result, the controller 30 decreases the discharge quantity of the left main pump 14L to a minimum allowable discharge quantity to control pressure loss (pumping loss) during passage of the discharged hydraulic oil through the left center bypass conduit 40L. When a hydraulic actuator is operated, hydraulic oil discharged by the left main pump 14L flows into the operated hydraulic actuator through a control valve corresponding to the operated hydraulic actuator. The flow of hydraulic oil discharged by the left main pump 14L that reaches the left throttle 18L is reduced in amount or lost, so that the control pressure generated upstream of the left throttle 18L is reduced. As a result, the controller 30 increases the discharge quantity of the left main pump 14L to circulate sufficient hydraulic oil to the operated hydraulic actuator, thereby ensuring the driving of the operated hydraulic actuator. The controller 30 controls the discharge quantity of the right main pump 14R in the same manner.

With the configuration as described above, the hydraulic system of FIG. 5 can reduce unnecessary energy consumption in the main pump 14L in the standby state. The unnecessary energy consumption includes pumping loss that is caused in the center bypass conduit 40 by hydraulic oil discharged by the main pump 14. Furthermore, in the case of actuating a hydraulic actuator, the hydraulic system of FIG. 5 can ensure that necessary and sufficient hydraulic oil is supplied from the main pump 14 to the hydraulic actuator to be actuated.

Figure 6A:
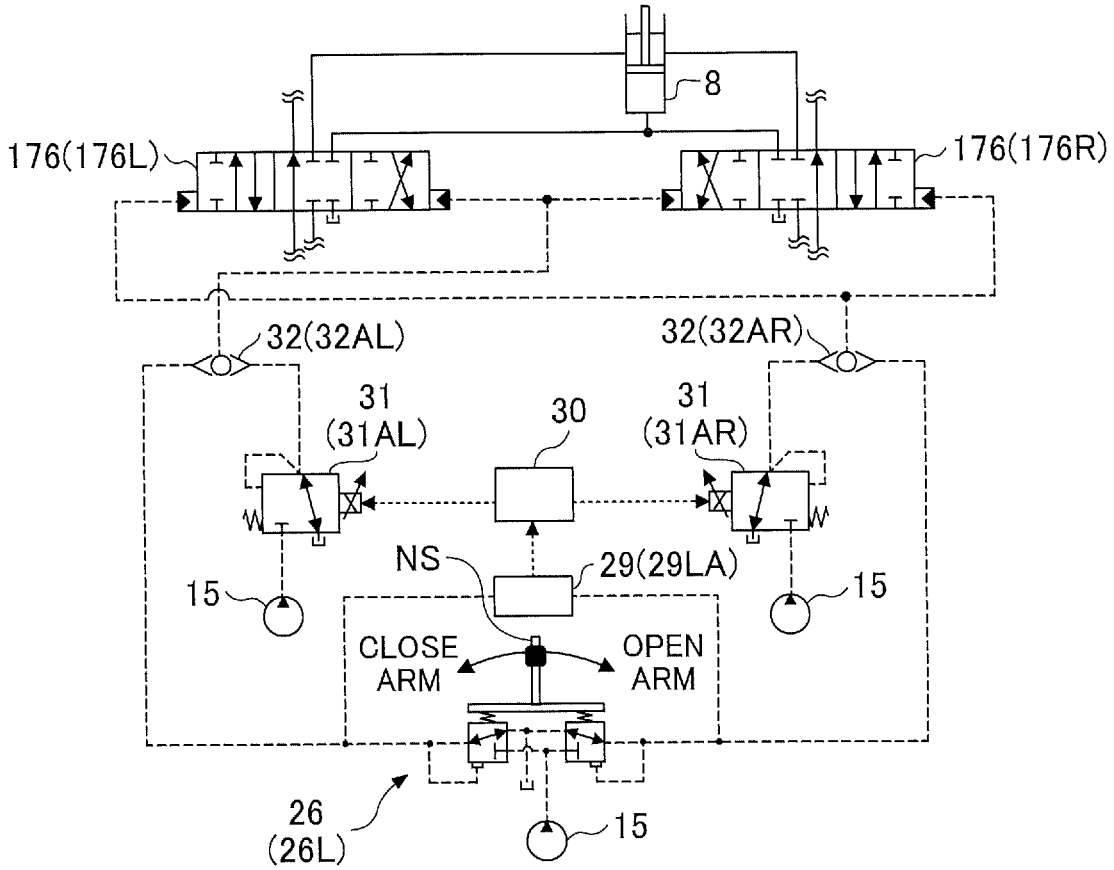
FIG. 6A is a diagram illustrating a part of the hydraulic system of FIG. 5.
Figure 6B:
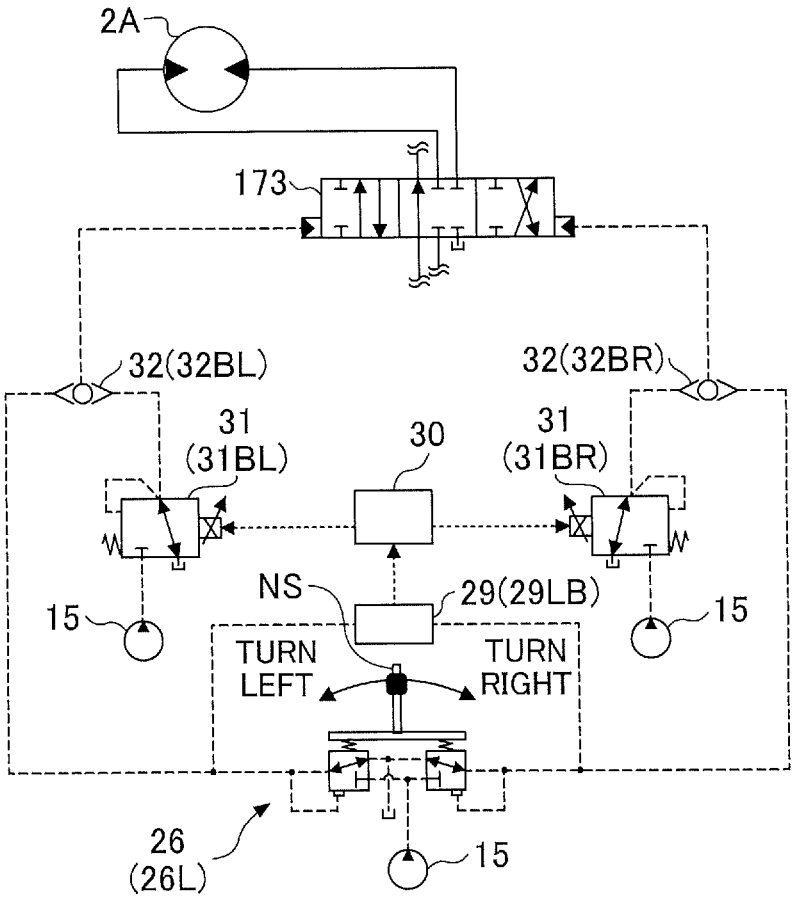
FIG. 6B is a diagram illustrating a part of the hydraulic system of FIG. 5.
Figure 6C:
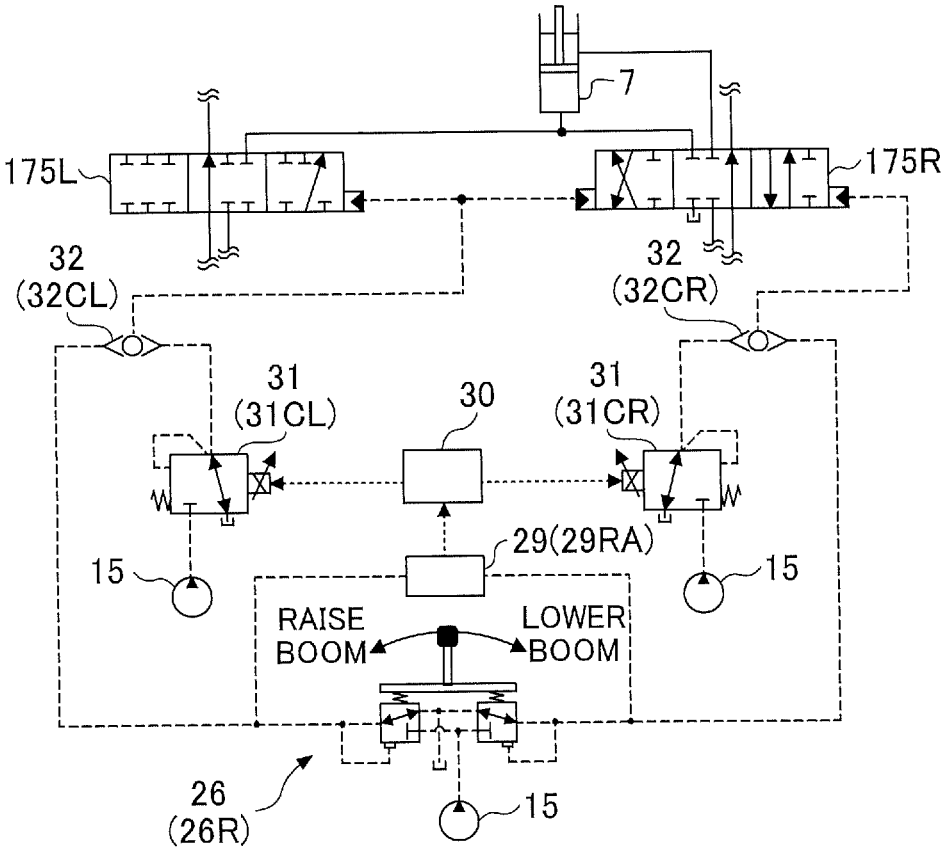
FIG. 6C is a diagram illustrating a part of the hydraulic system of FIG. 5.
Figure 6D:
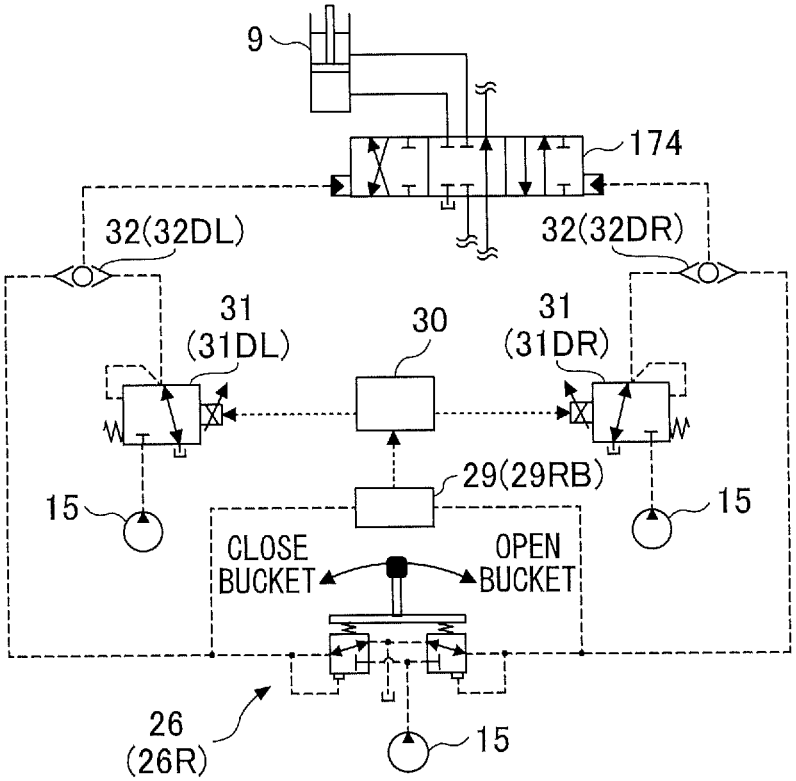
FIG. 6D is a diagram illustrating a part of the hydraulic system of FIG. 5.

Next, a configuration in which the controller 30 uses the machine control function to automatically operate an actuator will be described with reference to FIG. 6A through FIG. 6D. FIG. 6A through FIG. 6D are diagrams illustrating parts of the hydraulic system. Specifically, FIG. 6A is a diagram illustrating a part of the hydraulic system related to the operation of the arm cylinder 8. FIG. 6B is a diagram illustrating a part of the hydraulic system related to the operation of the turning hydraulic motor 2A. FIG. 6C is a diagram illustrating a part of the hydraulic system related to the operation of the boom cylinder 7. FIG. 6D is a diagram illustrating a part of the hydraulic system related to the operation of the bucket cylinder 9.

As illustrated in FIG. 6A through FIG. 6D, the hydraulic system includes a proportional valve 31 and a shuttle valve 32. The proportional valve 31 includes proportional valves 31AL through 31DL and 31AR through 31DR. The shuttle valve 32 includes shuttle valves 32AL through 32DL and 32AR through 32DR.

The proportional valve 31 operates as a control valve for machine control. The proportional valve 31 is placed in a conduit connecting the pilot pump 15 and the shuttle valve 32, and is configured to be able to change the flow area of the conduit. In the present embodiment, the proportional valve 31 operates in response to a control command output from the controller 30. Therefore, the controller 30 can supply hydraulic oil discharged by the pilot pump 15 to a pilot port of a corresponding control valve in the control valve 17 through the proportional valve 31 and the shuttle valve 32, independent of the operator's operation of the operation device 26.

The shuttle valve 32 includes two inlet ports and one outlet port. One of the two inlet ports is connected to the operation device 26, and the other is connected to the proportional valve 31. The outlet port is connected to a pilot port of a corresponding control valve in the control valve 17. Therefore, the shuttle valve 32 can cause the higher one of a pilot pressure generated by the operation device 26 and a pilot pressure generated by the proportional valve 31 to act on a pilot port of a corresponding control valve.

With the above-described configuration, the controller 30 can operate a hydraulic actuator corresponding to a specific operation device 26 even when no operation is performed on the specific operation device 26.

For example, as illustrated in FIG. 6A, the left operating lever 26L is used to operate the arm 5. Specifically, the left operating lever 26L causes a pilot pressure corresponding to a forward or backward operation to act on a pilot port of the control valve 176, using hydraulic oil discharged by the pilot pump 15. More specifically, when operated in the arm closing direction (backward), the left operating lever 26L causes a pilot pressure corresponding to the amount of operation to act on the right pilot port of the control valve 176L and the left pilot port of the control valve 176R. Further, when operated in the arm opening direction (forward), the left operating lever 26L causes a pilot pressure corresponding to the amount of operation to act on the left pilot port of the control valve 176L and the right pilot port of the control valve 176R.

The left operating lever 26L is provided with a switch NS. In the present embodiment, the switch NS is a push button switch. The operator can operate the left operating lever 26L while pressing the switch NS. The switch NS may be provided on the right operating lever 26R or at a different position in the cabin 10.

The operating pressure sensor 29LA detects the details of the operator's forward or backward operation of the left operating lever 26L in the form of pressure, and outputs the detected value to the controller 30.

The proportional valve 31AL operates in response to a current command output from the controller 30. The proportional valve 31AL controls a pilot pressure generated by hydraulic oil introduced to the right pilot port of the control valve 176L and the left pilot port of the control valve 176R from the pilot pump 15 through the proportional valve 31AL and the shuttle valve 32AL. The proportional valve 31AR operates in response to a current command output from the controller 30. The proportional valve 31AR controls a pilot pressure generated by hydraulic oil introduced to the left pilot port of the control valve 176L and the right pilot port of the control valve 176R from the pilot pump 15 through the proportional valve 31AR and the shuttle valve 32AR. The proportional valves 31AL and 31AR can control the pilot pressure such that the control valves 176L and 176R can stop at a desired valve position.

With the above-described configuration, the controller 30 can supply hydraulic oil, discharged by the pilot pump 15, to the right pilot port of the control valve 176L and the left pilot port of the control valve 176R through the proportional valve 31AL and the shuttle valve 32AL, independent of the operator's arm closing operation. That is, the arm 5 can be automatically closed. Further, the controller 30 can supply hydraulic oil, discharged by the pilot pump 15, to the left pilot port of the control valve 176L and the right pilot port of the control valve 176R through the proportional valve 31AR and the shuttle valve 32AR, independent of the operator's arm opening operation. That is, the arm 5 can be automatically opened.

Further, as illustrated in FIG. 6B, the left operating lever 26L is also used to operate the turning mechanism 2. Specifically, the left operating lever 26L causes a pilot pressure corresponding to a rightward or leftward operation to act on a pilot port of the control valve 173, using hydraulic oil discharged by the pilot pump 15. More specifically, when operated in the left turning direction (leftward), the left operating lever 26L causes a pilot pressure corresponding to the amount of operation to act on the left pilot port of the control valve 173. Furthermore, when operated in the right turning direction (rightward), the left operating lever 26L causes a pilot pressure corresponding to the amount of operation to act on the right pilot port of the control valve 173.

The operating pressure sensor 29LB detects the details of the operator's rightward or leftward operation of the left operating lever 26L in the form of pressure, and outputs the detected value to the controller 30.

The proportional valve 31BL operates in response to a current command output from the controller 30. The proportional valve 31BL controls a pilot pressure generated by hydraulic oil introduced to the left pilot port of the control valve 173 from the pilot pump 15 through the proportional valve 31BL and the shuttle valve 32BL. The proportional valve 31BR operates in response to a current command output from the controller 30. The proportional valve 31BR controls a pilot pressure generated by hydraulic oil introduced to the right pilot port of the control valve 173 from the pilot pump 15 through the proportional valve 31BR and the shuttle valve 32BR. The proportional valves 31BL and 31BR can control the pilot pressure such that the control valve 173 can stop at a desired valve position.

With the above-described configuration, the controller 30 can supply hydraulic oil, discharged by the pilot pump 15, to the left pilot port of the control valve 173 through the proportional valve 31BL and the shuttle valve 32BL, independent of the operator's left turning operation. That is, the turning mechanism 2 can be automatically turned counterclockwise. Furthermore, the controller 30 can supply hydraulic oil, discharged by the pilot pump 15, to the right pilot port of the control valve 173 through the proportional valve 31BR and the shuttle valve 32BR, independent of the operator's right turning operation. That is, the turning mechanism 2 can be automatically turned clockwise.

As illustrated in FIG. 6C, the right operating lever 26R is used to operate the boom 4. Specifically, the right operating lever 26R causes a pilot pressure corresponding to a forward or backward operation to act on a pilot port of the control valve 175, using hydraulic oil discharged by the pilot pump 15. More specifically, when operated in the boom raising direction (backward), the right operating lever 26R causes a pilot pressure corresponding to the amount of operation to act on the right pilot port of the control valve 175L and the left pilot port of the control valve 175R. Furthermore, when operated in the boom lowering direction (forward), the right operating lever 26R causes a pilot pressure corresponding to the amount of operation to act on the right pilot port of the control valve 175R.

The operating pressure sensor 29RA detects the details of the operator's forward or backward operation of the right operating lever 26R in the form of pressure, and outputs the detected value to the controller 30.

The proportional valve 31CL operates in response to a current command output from the controller 30. The proportional valve 31CL controls a pilot pressure generated by hydraulic oil introduced to the right pilot port of the control valve 175L and the left pilot port of the control valve 175R from the pilot pump 15 through the proportional valve 31CL and the shuttle valve 32CL. The proportional valve 31CR operates in response to a current command output from the controller 30. The proportional valve 31CR controls a pilot pressure generated by hydraulic oil introduced to the left pilot port of the control valve 175L and the right pilot port of the control valve 175R from the pilot pump 15 through the proportional valve 31CR and the shuttle valve 32CR. The proportional valves 31CL and 31CR can control the pilot pressure such that the control valves 175L and 175R can stop at a desired valve position.

With the above-described configuration, the controller 30 can supply hydraulic oil, discharged by the pilot pump 15, to the right pilot port of the control valve 175L and the left pilot port of the control valve 175R through the proportional valve 31CL and the shuttle valve 32CL, independent of the operator's boom raising operation. That is, the boom 4 can be automatically raised. Furthermore, the controller 30 can supply hydraulic oil, discharged by the pilot pump 15, to the right pilot port of the control valve 175R through the proportional valve 31CR and the shuttle valve 32CR, independent of the operator's boom lowering operation. That is, the boom 4 can be automatically lowered.

As illustrated in FIG. 6D, the right operating lever 26R is also used to operate the bucket 6. Specifically, the right operating lever 26R causes a pilot pressure corresponding to a rightward or leftward operation to act on a pilot port of the control valve 174, using hydraulic oil discharged by the pilot pump 15. More specifically, when operated in the bucket closing direction (leftward), the right operating lever 26R causes a pilot pressure corresponding to the amount of operation to act on the left port of the control valve 174. Furthermore, when operated in the bucket opening direction (rightward), the right operating lever 26R causes a pilot pressure corresponding to the amount of operation to act on the right pilot port of the control valve 174.

The operating pressure sensor 29RB detects the details of the operator's rightward or leftward operation of the right operating lever 26R in the form of pressure, and outputs the detected value to the controller 30.

The proportional valve 31DL operates in response to a current command output from the controller 30. The proportional valve 31DL controls a pilot pressure generated by hydraulic oil introduced to the left pilot port of the control valve 174 from the pilot pump 15 through the proportional valve 31DL and the shuttle valve 32DL. The proportional valve 31DR operates in response to a current command output from the controller 30. The proportional valve 31DR controls a pilot pressure generated by hydraulic oil introduced to the right pilot port of the control valve 174 from the pilot pump 15 through the proportional valve 31DR and the shuttle valve 32DR. The proportional valves 31DL and 31DR can control the pilot pressure such that the control valve 174 can stop at a desired valve position.

With the above-described configuration, the controller 30 can supply hydraulic oil, discharged by the pilot pump 15, to the left pilot port of the control valve 174 through the proportional valve 31DL and the shuttle valve 32DL, independent of the operator's bucket closing operation. That is, the bucket 6 can be automatically closed. Furthermore, the controller 30 can supply hydraulic oil, discharged by the pilot pump 15, to the right pilot port of the control valve 174 through the proportional valve 31DR and the shuttle valve 32DR, independent of the operator's bucket opening operation. That is, the bucket 6 can be automatically opened.

The shovel 100 may include a configuration in which the lower traveling body 1 automatically travels forward and backward. In this case, a part of the hydraulic system related to the operation of the left travel hydraulic motor 2ML and a part of the hydraulic system related to the operation of the right traveling hydraulic motor 2MR may be configured in the same manner as the part of the hydraulic system related to the operation of the boom cylinder 7.

In FIG. 2, FIG. 5, and FIG. 6A through FIG. 6D, a hydraulic operating lever including a hydraulic pilot circuit has been described. However, an electrical operating lever including an electrical pilot circuit may be employed instead of the hydraulic operating lever. In this case, the lever operation amount of the electrical operating lever is input to the controller 30 as an electrical signal. Further, a solenoid valve is placed between the pilot pump 15 and a pilot port of each control valve. The solenoid valve is configured to operate in response to an electrical signal from the controller 30. With this configuration, when a manual operation using the electrical operating lever is performed, the controller 30 can move each control valve by controlling the solenoid valve using an electrical signal corresponding to the lever operation amount so as to increase or decrease a pilot pressure. Note that each of the control valves may be constituted of a solenoid spool valve. In this case, the solenoid spool valve operates in response to an electrical signal from the controller 30 corresponding to the lever operation amount of the electrical operating lever.

Figure 7:
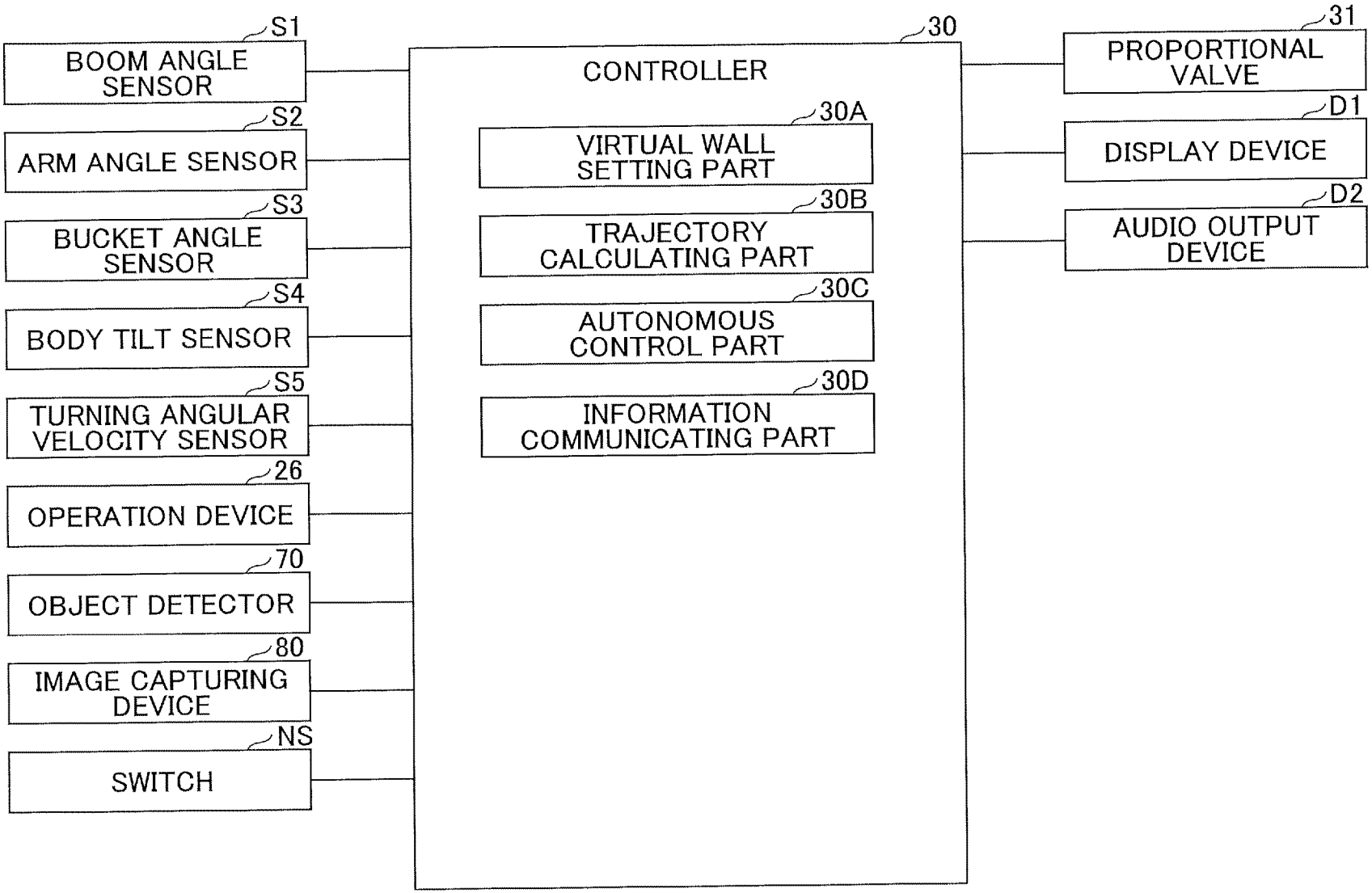
FIG. 7 is a diagram illustrating an example configuration of the controller.

Next, functions of the controller 30 will be described with reference to FIG. 7. FIG. 7 is a diagram illustrating an example configuration of the controller 30. In the example of FIG. 7, the controller 30 is configured to receive signals output from the orientation detector, the operation device 26, the object detector 70, the image capturing device 80, the switch NS, and the like, execute various computations, and output control signals to the proportional valve 31, the display device D1, the audio output device D2, and the like. The orientation detector includes at least one of the boom angle sensor S1, the arm angle sensor S2, the bucket angle sensor S3, the body tilt sensor S4, and the turning angular velocity sensor S5. The controller 30 includes a virtual wall setting part 30A, a trajectory calculating part 30B, and an autonomous control part 30C, and an information communicating part 30D as functional elements. The functional elements may be constituted of hardware, or may constituted of software.

The virtual wall setting part 30A is configured to set a virtual wall VW based on the output of the surroundings monitoring device. The virtual wall VW separates a working range of the shovel 100. In the present embodiment, the virtual wall setting part 30A sets a virtual wall VW based on the output of the LIDAR serving as object detector 70, which is an example of the surroundings monitoring device. For example, the virtual wall setting part 30A estimates that the shape of an unexcavated portion of an excavation object such as the ground after being excavated, based on the shape of a portion already excavated (hereinafter referred to as an "already excavated portion"). Then, the virtual wall setting part 30A sets a virtual wall VW based on the estimated shape of the unexcavated portion. In this case, the virtual wall setting part 30A estimates the shape of the unexcavated portion after being excavated, based on the assumption that the unexcavated portion is formed in the same shape as that of the already excavated portion. The virtual wall VW is set such that the shape of the unexcavated portion does not deviate from the estimated shape during a subsequent excavation operation. With this configuration, the controller 30 can prevent the movement of the tip of the bucket 6 beyond the virtual wall VW during a subsequent excavation operation.

For example, the virtual wall setting part 30A uses the output of the LIDAR to acquire information on the excavated surface of an already excavated portion of the ground where a retaining wall is to be constructed, based on the shape of the excavated surface of the already excavated portion. The information on the excavated surface includes at least one of the height of the excavated surface, the inclination of the reference horizontal plane, and the inclination of the reference vertical plane. The virtual wall setting part 30A estimates the shape of the surface (hereinafter referred to as an "estimated surface") of an unexcavated portion, based on the assumption that the surface of the unexcavated portion is formed in the same shape as that of the already excavated portion. In this case, the excavated surface of the already excavated portion and the estimated surface of the unexcavated portion are in the same plane. The virtual wall setting part 30A sets a plane extending along the estimated surface as a virtual wall VW.

The trajectory calculating part 30B is configured to calculate a target trajectory that is a trajectory followed by a predetermined part of the attachment when the shovel 100 is autonomously operated. For example, the predetermined part may be the tip of the bucket 6. In the present embodiment, the trajectory calculating part 30B calculates a target trajectory to be used by the autonomous control part 30C when causing the shovel 100 to autonomously operate. For example, the trajectory calculating part 30B calculates a target trajectory such that the tip of the bucket 6 does not cross the virtual wall VW. Specifically, the trajectory calculating part 30B calculates a target trajectory for moving the tip of the bucket 6 along the virtual wall VW, such that the tip of the bucket 6 does not move beyond the virtual wall VW.

The autonomous control part 30C is configured to cause the shovel 100 to autonomously operate. In the present embodiment, the autonomous control part 30C is configured to move a predetermined part of the shovel 100 along a target trajectory calculated by the trajectory calculating part 30B in a case where a predetermined start condition is satisfied. The case where "a predetermined start condition is satisfied" may include at least one of a case where "the distance between a virtual wall VW set by the virtual wall setting part 30A and the tip of the bucket 6 falls below a predetermined value" and a case where "the operation device 26 is operated with the switch NS being pressed". For example, when the left operating lever 26L is operated in the right turning direction and the right operating lever 26R is operated in the boom raising direction with the switch NS being pressed, the autonomous control part 30C may cause the shovel 100 to autonomously operate such that the tip of the bucket 6 moves along a target trajectory. For example, each of the left operating lever 26L and the right operating lever 26R may be operated with any lever operation amount. In this case, the operator can move the tip of the bucket 6 along the target trajectory at a predetermined movement speed, without paying attention to the lever operation amount. Alternatively, the movement speed of the bucket 6 may be changed in accordance with the lever operation amount of the left operating lever 26L or the right operating lever 26R.

The autonomous control part 30C may be configured to control at least one of the hydraulic actuators, such that the tip of the bucket 6 moves along the target trajectory. For example, the autonomous control part 30C may semi-automatically control the turning speed of the upper turning body 3 in accordance with the speed at which the boom 4 is raised. For example, the autonomous control part 30C may increase the turning speed of the upper turning body 3 as the speed at which the boom 4 is raised increases. In this case, while the boom 4 is raised at a speed corresponding to the lever operation amount of the right operating lever 26R in the boom raising direction, the upper turning body 3 may turn at a speed different from a speed corresponding to the lever operation amount of the left operating lever 26L in the right turning direction.

Alternatively, the autonomous control part 30C may semi-automatically control the speed at which the boom 4 is raised in accordance with the turning speed of the upper turning body 3. For example, the autonomous control part 30C may increase the speed at which the boom 4 is raised as the turning speed of the upper turning body 3 increases. In this case, while the upper turning body 3 may be turned at a speed corresponding to the lever operation amount of the left operating lever 26L in the right turning direction, the boom 4 may be raised at a speed different from a speed corresponding to the lever operation amount of the right operating lever 26R in the boom raising direction.

Alternatively, the autonomous control part 30C may semi-automatically control both the turning speed of the upper turning body 3 and the speed at which the boom 4 is raised. In this case, the upper turning body 3 may be turned at a speed different from a speed corresponding to the lever operation amount of the left operating lever 26L in the right turning direction. Likewise, the boom 4 may be raised at a speed different from a speed corresponding to the lever operation amount of the right operating lever 26R in the boom raising direction.

The information communicating part 30D is configured to communicate various kinds of information to the operator of the shovel 100. In the present embodiment, the information communicating part 30D is configured to notify the operator of the shovel 100 of the distance between the tip of the bucket 6 and a virtual wall VW during excavation work. Specifically, the information communicating part 30D is configured to use visual information and aural information to notify the operator of the shovel 100 of the horizontal distance between the tip of the bucket 6 and a virtual wall VW.

For example, the information communicating part 30D may use intermittent sounds through the audio output device D2 to notify the operator of the horizontal distance. In this case, the information communicating part 30D may reduce the interval between intermittent sounds as the horizontal distance decreases. The information communicating part 30D may use a continuous sound to represent the horizontal distance. The information communicating part 30D may represent variations in the horizontal distance by changing the pitch, loudness, or the like of the sound. Further, the information communicating part 30D may output an alarm when the horizontal distance falls below a predetermined value. For example, the alma may be a continuous sound significantly louder than the intermittent sounds.

The information communicating part 30D may display the horizontal distance between the tip of the bucket 6 and the virtual wall VW on the display device D1 as work information. For example, the display device D1 displays the work information received from the information communicating part 30D on a screen, together with image data received from the image capturing device 80. The information communicating part 30D may use an image of an analog meter, an image of a bar graph indicator, or the like to notify the operator of the horizontal distance.

Figure 8:
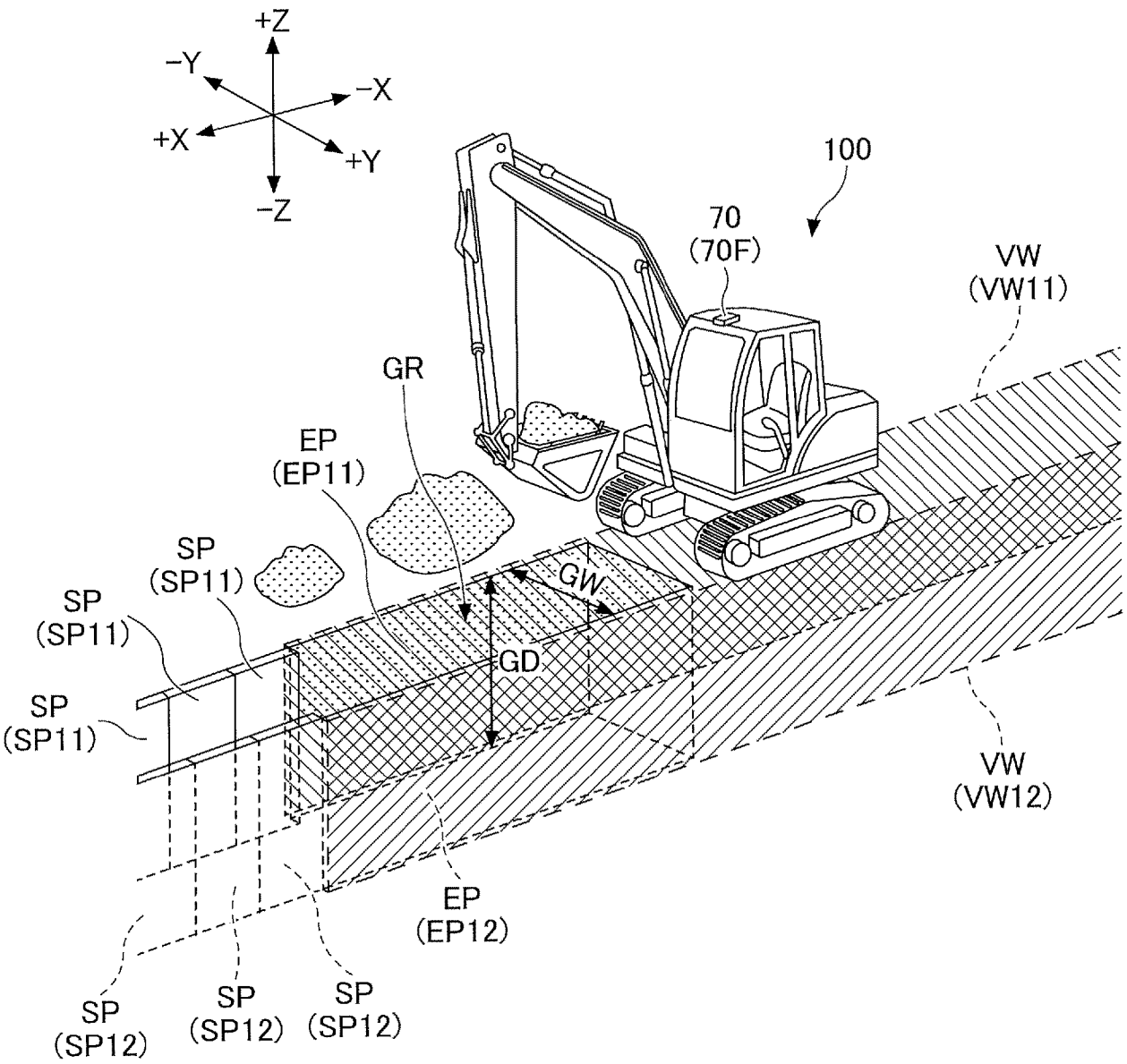
FIG. 8 is a perspective view of the shovel.

Next, another example of the restriction function of restricting the movement of the shovel 100 will be described with reference to FIG. 8. FIG. 8 is a perspective view of the shovel 100 that excavates a linear groove GR. FIG. 8 depicts a situation in which sheet piles SP are installed on wall surfaces of the already excavated groove GR. Specifically, FIG. 8 depicts a situation in which the shovel 100 repeats an operation of linearly excavating the ground from the left side and installing sheet piles SP on both side wall surfaces of the groove GR, while proceeding with the excavation to the right side. More specifically, FIG. 8 depicts a situation in which sheet piles SP11 are installed along a wall surface on the −Y side (the far side of the figure) of the groove GR, and sheet piles SP12 are installed along a wall surface on the +Y side (the near side of the figure) of the groove GR. There is a portion of the groove GR where no sheet piles SP are installed, and an excavated surface EP is exposed. The excavated surface EP includes an excavated surface EP11, which is a wall surface on the −Y side (the far side of the figure) of the groove GR, and an excavated surface EP12, which is a wall surface on the +Y side (the near side of the figure) of the groove GR.

For example, the controller 30 identifies that the groove GR has a depth GD and a width GW, and that the sheet piles SP are installed to extend continuously along the XZ plane, based on the output of the LIDAR serving as the object detector 70, which is an example of the surroundings monitoring device. In addition, the controller 30 identifies that the excavated surface EP, where no sheet piles SP are installed, extends continuously along the XZ plane.

The controller 30 estimates the shape of the surface of an unexcavated portion on the assumption that the unexcavated portion is formed in the same shape as that of the already excavated portion. Specifically, the controller 30 estimates that the groove GR having the depth GD and the width GW further extends in the −X direction. Then, the controller 30 sets a virtual wall VW along the estimated surface of the unexcavated portion that is in the same plane as the excavated surface EP. Specifically, the controller 30 sets a virtual wall VW11 along the estimated surface of the unexcavated portion that is in the same plane as the excavated surface EP11, which is formed on the −Y side (the far side of the figure) of the groove GR. In addition, the controller 30 sets a virtual wall VW12 along the estimated surface that is in the same plane as the excavated surface EP12, which is formed on the +Y side (the near side of the figure) of the groove GR. In FIG. 8, the virtual wall VW11 is indicated by a striped pattern diagonally downward to the right and the virtual wall VW12 is indicated by a striped pattern diagonally upward to the right. The virtual wall VW11 is set to extend from the end on the −X side of the sheet piles SP11 in the −X direction along the excavated surface EP11. Accordingly, the controller 30 can prevent the bucket 6 from damaging the excavated surface EP of the already excavated portion, and can assist the installation of sheet piles along the virtual wall VW11 (the excavated surface EP of the already excavated portion). Further, similar to the already excavated portion, the virtual wall VW11 set along the unexcavated portion has the same depth as the depth GD of the groove GR. Accordingly, the controller 30 can assist excavation work for forming an excavated surface EP on the unexcavated portion such that the excavated surface EP of the unexcavated portion is formed in the same shape as that of the already excavated portion. Further, the upper end of the virtual wall VW11 is at the same level as the ground. Thus, the movement of the shovel 100 above the ground level is not restricted. The same applies to the virtual wall VW12.

The controller 30 may use the above-described virtual wall VW to restrict the movement of an actuator. For example, the controller 30 may restrict the movement of the turning hydraulic motor 2A such that the tip of the bucket 6 does not enter the ground beyond the virtual wall VW.

Further, the controller 30 may use the virtual wall VW to assist the operator in the operation of an actuator, instead of restricting the movement of the actuator or in addition to restricting the movement of the actuator. For example, the controller 30 may use visual information and aural information to notify the operator of the horizontal distance between the tip of the bucket 6 and the virtual wall VW.

Further, in the above-described example, the controller 30 sets the virtual wall VW after identifying that the groove GR is formed and the sheet piles SP are installed. However, the controller 30 may set the virtual wall VW based on the excavated surface EP after identifying that the groove GR is formed and before identifying that the sheet piles SP are installed. Alternatively, the controller 30 may set the virtual wall VW based on information on the sheet piles SP only, such as the height of the sheet piles SP and the distance between two facing sheet piles SP, irrespective of information on the excavated surface EP before the installation of the sheet piles SP.

As described above, according to the embodiment of the present invention, the shovel 100 includes the lower traveling body 1, the upper turning body 3 turnably mounted on the lower traveling body 1, an actuator mounted on the upper turning body 3, and the controller 30 serving as a control device configured to restrict the movement of the actuator. The actuator includes at least one of a hydraulic actuator and an electric actuator. The hydraulic actuator includes at least one of the left traveling hydraulic motor 2ML, the right traveling hydraulic motor 2MR, the turning hydraulic motor 2A, the boom cylinder 7, the arm cylinder 8, and the bucket cylinder 9. The controller 30 is configured to set a virtual wall VW, and restrict the movement of the actuator based on the positional relationship between the virtual wall VW and the shovel 100. With this configuration, the controller 30 can appropriately restrict the movement of the shovel 100. For example, the controller 30 can restrict the movement of the shovel 100 even if no object approaches the shovel 100. That is, the controller 30 can appropriately restrict the movement of the shovel 100 without determining whether there is an object approaching the shovel 100. Therefore, it is possible to prevent unnecessary restriction of the movement of the shovel 100 due to incorrect detection of an object approaching the shovel 100. Accordingly, the controller 30 can improve work efficiency of the shovel 100.

The controller 30 may be configured to set a virtual wall VW based on an object located in a work environment. The object includes at least one of a utility pole, a fence, and the ground.

The shovel 100 preferably includes a surroundings monitoring device attached to the upper turning body 3. For example, the surroundings monitoring device includes at least one of the object detector 70 and the image capturing device 80. That is, the shovel 100 does not need to include both the object detector 70 and the image capturing device 80. As long as the positional relationship between a surrounding object and the shovel 100 can be identified, the shovel 100 may be configured to include just the object detector 70. Alternatively, as long as the positional relationship between a surrounding object and the shovel 100 can be identified, the shovel 100 may include the image capturing device 80 only. The controller 30 may be configured to detect an object based on the output of the surroundings monitoring device and set a virtual wall VW based on the object.

The controller 30 may be configured to derive the regularity of the shape of an object or the arrangement of objects based on the output of the surroundings monitoring device, and set a virtual wall VW based on the regularity of the shape of the object or the arrangement of the objects. For example, the regularity may include at least one of continuity, linearity, symmetry, and repeatability.

The controller 30 may be configured to set a virtual wall VW based on the arrangement of a plurality of road cones RC placed in the vicinity of the shovel 100. With this configuration, the controller 30 can readily set the virtual wall VW.

The controller 30 may be configured to slow or stop the movement of an actuator in response to determining that a part of the shovel 100 crosses a virtual wall VW. For example, the controller 30 may determine that a part of the shovel 100 crosses a virtual wall VW when the distance between the part of the shovel 100 and the virtual wall VW becomes zero. With this configuration, the controller 30 can promptly stop the actuator when the part of the shovel 100 has crossed the virtual wall VW.

For example, the controller 30 may be configured to slow or stop the movement of an actuator such that a part of the shovel 100 does not cross a virtual wall VW. For example, the controller 30 may determine that there is a possibility that a part of the shovel 100 may cross a virtual wall VW when the distance between the part of the shovel 100 and the virtual wall VW falls below a predetermined value. Then, the controller 30 may slow or stop the movement of an actuator. With this configuration, the controller 30 can stop the movement of the actuator before the part of the shovel 100 crosses the virtual wall VW. As a result, the controller 30 can prevent the part of the shovel 100 from crossing the virtual wall VW.

For example, the controller 30 may be configured to determine that a part of the shovel 100 may cross a virtual wall VW when the distance between a point on the outer surface of the shovel 100 and the virtual wall VW falls below a predetermined value. The outer surface of the shovel 100 includes the outer surface of the lower traveling body 1, the outer surface of the upper turning body 3, and the outer surface of the excavation attachment AT.

For example, the controller 30 uses a hypothetical three-dimensional model, such as a polygon model or a wireframe model, to identify the three-dimensional overall outline (outer surface) of the shovel 100, and calculates the coordinates of points on the outer surface of the shovel 100. The outer surface of the lower traveling body 1 includes, for example, the front surface, the upper surface, the lower surface, and the rear surface of the crawlers 1C. The outer surface of the upper turning body 3 includes, for example, the surface of a side cover, the upper surface of the engine hood, and the upper surface, the left side surface, the right side surface, and the rear surface of the counterweight. The outer surface of the excavation attachment AT includes, for example, the rear surface, the left side surface, the right side surface, and the inner surface of the boom 4, and also includes the rear surface, the left side surface, the right side surface, and the inner surface of the arm 5.

Figure 9A:
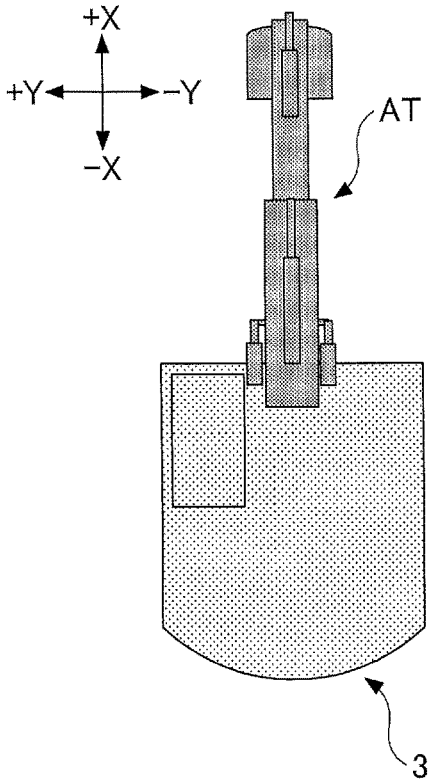
FIG. 9A through FIG. 9C are diagrams illustrating configuration examples of outer surfaces of the shovel.
Figure 9B:
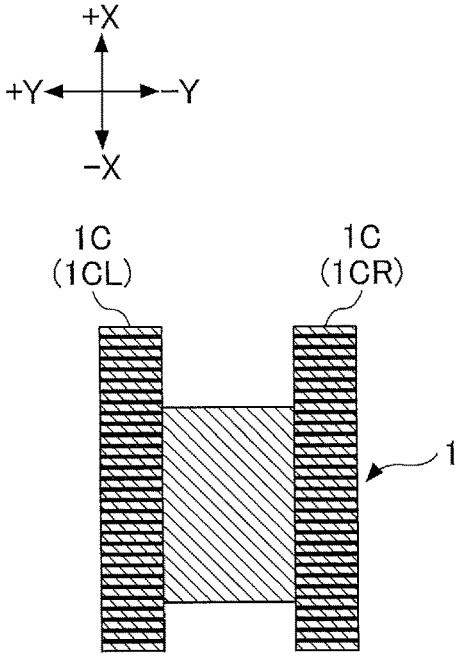
Figure 9C:
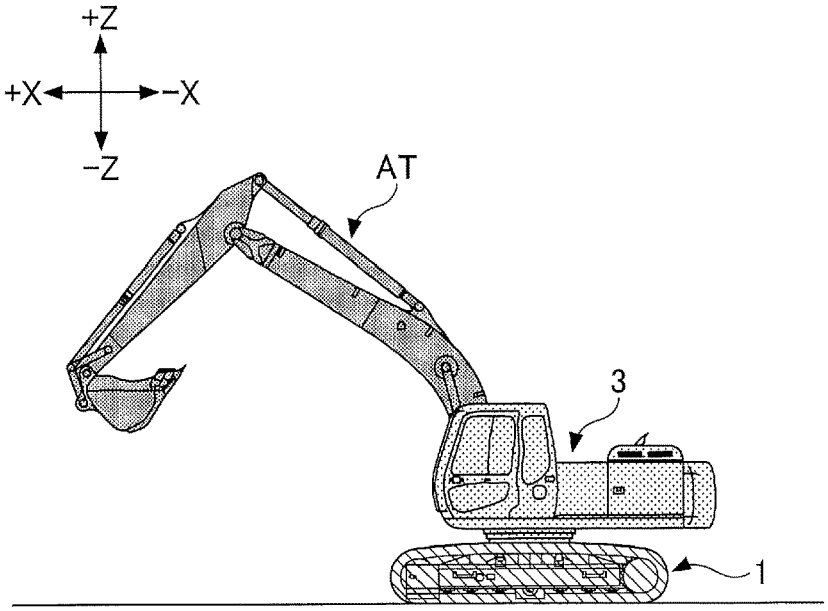

FIG. 9A through FIG. 9C are diagrams illustrating configuration examples of outer surfaces of polygon models of the shovel 100. FIG. 9A is a top view of a polygon model of the upper turning body 3 and the excavation attachment AT. FIG. 9B is a top view of a polygon model of the lower traveling body 1. FIG. 9C is a left side view of a polygon model of the shovel 100. In FIG. 9A through FIG. 9C, the outer surface of the lower traveling body 1 is represented by diagonal lines, the outer surface of the upper turning body 3 is represented by a rough dot pattern, and the outer surface of the excavation attachment AT is represented by a fine dot pattern.

The outer surface of each of the polygon models of the shovel 100 may be identified as a surface located outward by a predetermined margin distance relative to the actual outer surface of the shovel 100. That is, the polygon models of the shovel 100 may be identified as respective enlarged models of the lower traveling body 1, the upper turning body 3, and the excavation attachment AT. In this case, the predetermined margin distance may be a distance that varies in accordance with the movement of the shovel 100 (e.g., the movement of the excavation attachment AT). The controller 30 may output an alarm when a virtual wall VW enters a space represented by the enlarged polygon models of the shovel 100, and may slow or stop the movement of the shovel 100 by means of restriction control.

For example, the controller 30 may separately determine whether there is a possibility that three portions (the outer surface of the lower traveling body 1, the outer surface of the upper turning body 3, and the outer surface of the excavation attachment AT) constituting the outer surface of the shovel 100 may cross a virtual wall VW. For at least one of the three portions of the shovel 100, the controller 30 is not required to determine whether there is a possibility of crossing a virtual wall VW.

In the example illustrated in FIG. 8, the controller 30 may calculate distances from points on the outer surface of the excavation attachment AT to the virtual walls VW11 and VW12 for each predetermined control period, and may determine whether the bucket 6 may cross the virtual wall VW11 or the virtual wall VW12 based on the calculated distances. In this case, the controller 30 is not required to calculate distances from points on the outer surface of the lower traveling body 1 to the virtual walls VW11 and VW12, and distances from points on the outer surface of the upper turning body 3 to the virtual walls VW11 and VW12.

Alternatively, at a work site where the shovel 100 may contact a power line installed above the shovel 100, the controller 30 may be configured to set a virtual wall (virtual ceiling) above the shovel 100. Then, the controller 30 may be configured to calculate distances from points on the outer surface of the excavation attachment AT (such as points on the outer surface of the end of the boom) to the virtual wall for each predetermined control period. In this case, the controller 30 is not required to calculate distances from points on the outer surface of the lower traveling body 1 to the virtual wall, and distances from points on the outer surface of the upper turning body 3 to the virtual wall.

Alternatively, at a work site where the shovel 100 may contact an object behind or beside the shovel 100, the controller 30 may be configured to set a virtual wall behind or beside the shovel 100. Then, the controller 30 may be configured to calculate distances from points on the outer surface of the upper turning body 3 (such as points on the outer surface of the counterweight) to the virtual wall for each predetermined control period. In this case, the controller 30 is not required to calculate distances from points on the outer surface of the lower traveling body 1 to the virtual wall, and distances from points on the outer surface of the excavation attachment AT to the virtual wall.

Alternatively, at a work site where the shovel 100 may contact an object located near the crawlers 1C and positioned lower than the crawlers 1C, the controller 30 may be configured to set a virtual wall in the vicinity of the lower traveling body 1 and to be lower than the crawlers 1C. Then, the controller 30 may be configured to calculate distances from points on the outer surface of the lower traveling body 1 (such as points on the outer surfaces of the crawlers 1C) to the virtual wall for each predetermined control period. In this case, the controller 30 is not required to calculate distances from points on the outer surface of the upper turning body 3 to the virtual wall, and distances from points on the outer surface of the excavation attachment AT to the virtual wall.

Referring to FIG. 10, yet another example of the restriction function will be described, in which the movement of the shovel 100 (turning hydraulic motor 2A) is restricted based on the distance between each of the three portions constituting the outer surface of the shovel 100 and an object detected by the object detector 70, which serves as the surroundings monitoring device. FIG. 10 is a diagram illustrating another example configuration of a controller 30.

In the example illustrated in FIG. 10, the controller 30 includes a virtual wall setting part 30A, a speed command generating part 30E, a state identifying part 30F, a distance determining part 30G, a restriction target determining part 30H, and a speed limit part 30S, as functional elements. The controller 30 is configured to receive signals output from the boom angle sensor S1, the arm angle sensor S2, the bucket angle sensor S3, the body tilt sensor S4, the turning angular velocity sensor S5, an electrical left operating lever 26L, the object detector 70, and the image capturing device 80, execute various computations, and output control commands to a proportional valve 31 and the like. Note that the virtual wall setting part 30A of FIG. 10 operates in the same manner as the virtual wall setting part 30A included in the controller 30 illustrated in FIG. 7.

The speed command generating part 30E is configured to generate a command related to the movement speed of each actuator based on a signal output from the operation device 26. In the example illustrated in FIG. 10, the speed command generating part 30E is configured to generate a command related to the rotational speed of the hydraulic motor 2A based on an electrical signal output from the left operating lever 26L that is operated in the horizontal direction.

The state identifying part 30F is configured to identify the current state of the shovel 100. Specifically, the state identifying part 30F includes an attachment state identifying part 30F1, an upper turning body state identifying part 30F2, and a lower traveling body state identifying part 30F3.

The attachment state identifying part 30F1 is configured to identify the current state of the excavation attachment AT. Specifically, the attachment state identifying part 30F1 is configured to calculate the coordinates of predetermined points on the outer surface of the excavation attachment AT. Examples of the predetermined points include all vertexes of the excavation attachment AT.

The upper turning body state identifying part 30F2 is configured to identify the current state of the upper turning body 3. Specifically, the upper turning body state identifying part 30F2 is configured to calculate the coordinates of predetermined points on the outer surface of the upper turning body 3. Examples of the predetermined points include all vertexes of the upper turning body 3.

The lower traveling body state identifying part 30F3 is configured to identify the current state of the lower traveling body 1. Specifically, the lower traveling body state identifying part 30F3 is configured to calculate the coordinates of predetermined points on the outer surface of the lower traveling body 1. Examples of the predetermined points include all vertexes of the lower traveling body 1.

The state identifying part 30F may determine to identify any of the states of the three portions (the outer surface of the lower traveling body 1, the outer surface of the upper turning body 3, and the outer surface of the excavation attachment AT) constituting the outer surface of the shovel 100, or determine not to identify any of the states of the three portions.

The distance determining part 30G is configured to determine whether the distance between each point on the outer surface of the shovel 100, calculated by the state identifying part 30F, and a virtual wall VW, set by the virtual wall setting part 30A, falls below a predetermined value.

The restriction target determining part 30H is configured to determine a restriction target. In the example illustrated in FIG. 10, the restriction target determining part 30H determines which actuator (hereinafter referred to as a "restriction target actuator") should be restricted in movement based on the output of the distance determining part 30G, namely based on whether the distance between any of the points on the outer surface of the shovel 100 and the virtual wall VW falls below the predetermined value.

The speed limit part 30S is configured to limit the movement speed of one or more actuators. In the example illustrated in FIG. 10, among speed commands generated by the speed command generating part 30E, the speed limit part 30S changes a speed command related to an actuator, which has been determined as a restriction target actuator by the restriction target determining part 30H, and outputs a control command, corresponding to the changed speed command, to the proportional valve 31.

Specifically, the speed limit part 30S changes a speed command related to the turning hydraulic motor 2A, which has been determined as a restriction target actuator by the restriction target determining part 30H, and outputs a control command, corresponding to the changed speed command, to a proportional valve 31BL or a proportional valve 31BR. In this manner, the rotational speed of the turning hydraulic motor 2A can be reduced or With the above-described restriction function, the controller 30 illustrated in FIG. 10 can slow or stop the movement of an actuator in order to prevent a part of the shovel 100 from crossing a virtual wall VW.

Figure 11:
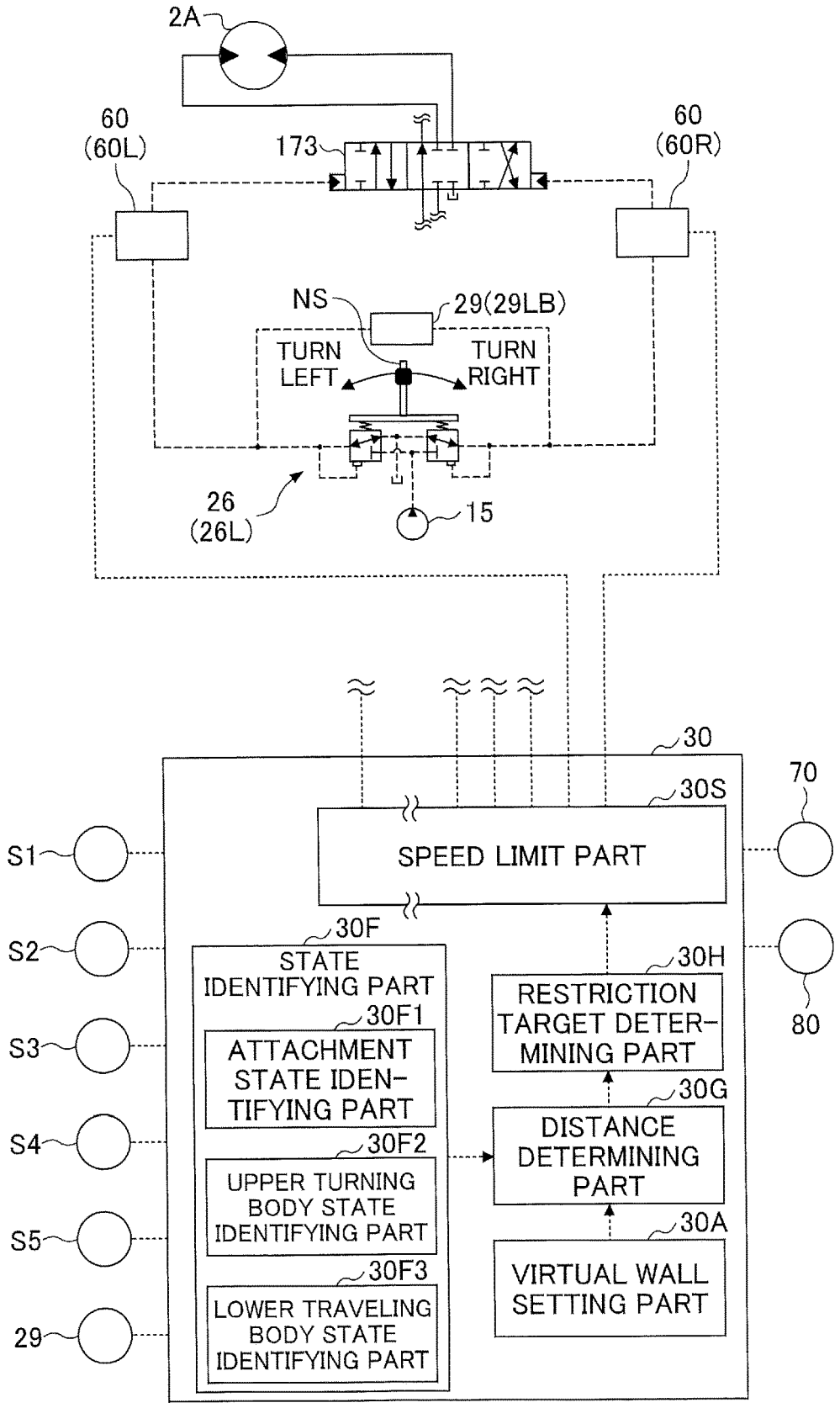
FIG. 11 is a diagram illustrating yet another example configuration of a controller.

Next, referring to FIG. 11, yet another example of the restriction function will be described, in which the movement of the shovel 100 (turning hydraulic motor 2A) is restricted based on the distance between each of the three portions constituting the outer surface of the shovel 100 and an object detected by the object detector 70, which serves as the surroundings monitoring device. FIG. 11 is a diagram illustrating yet another example configuration of a controller 30.

The controller 30 illustrated in FIG. 11 differs from the controller 30 illustrated in FIG. 10, in that the controller 30 illustrated in FIG. 11 is connected to a hydraulic operating lever including a hydraulic pilot circuit while the controller 30 illustrated in FIG. 10 is connected to the electrical operating lever including a hydraulic pilot circuit. Specifically, a speed limit part 30S of the controller 30 illustrated in FIG. 11 generates speed commands based on outputs of an operating pressure sensor 29, and the speed limit part 30S of the controller 30 illustrated in FIG. 11 changes, among the generated speed commands, a speed command related to an actuator that has been determined as a restriction target actuator by a restriction target determining part 30H. Then, the speed limit part 30S outputs a control command, corresponding to the changed speed command, to a solenoid valve 60 related to the actuator.

The solenoid valve 60 includes a solenoid valve 60L and a solenoid valve 60R. In the example illustrated in FIG. 11, the solenoid valve 60L is an electromagnetic proportional valve placed in a conduit connecting a left-side port of a remote control valve, which discharges hydraulic oil when the left operating lever 26L is operated in the horizontal direction, to a left-side pilot port of a control valve 173. The solenoid valve 60R is an electromagnetic proportional valve placed in a conduit connecting a right-side port of a remote control valve, which discharges hydraulic oil when the left operating lever 26L is operated in the horizontal direction, to a right-side pilot port of the control valve 173.

Specifically, the speed limit part 30S changes a speed command related to the turning hydraulic motor 2A, which has been determined as a restriction target actuator by the restriction target determining part 30H, and outputs a control command, corresponding to the changed speed command, to the solenoid valve 60L or the solenoid valve 60R. In this manner, the rotational speed of the turning hydraulic motor 2A can be reduced or stopped.

Similar to the controller 30 illustrated in FIG. 10, with the above-described restriction function, the controller 30 illustrated in FIG. 11 can slow or stop the movement of an actuator in order to prevent a part of the shovel 100 from crossing virtual wall VW.

The controller 30 may be configured to set a virtual wall based on object data input into a construction plan drawing, and restrict the movement of an actuator based on the positional relationship between the virtual wall and the shovel 100. The construction plan drawing may be design data.

Although the embodiment of the present invention has been described in detail above, the present invention is not limited to the particulars of the above-described embodiment. Variations and replacements, may be applied to the above-described embodiment without departing from the scope of the present invention. Furthermore, the separately described features may be suitably combined as long as no technical contradiction occurs.

For example, in the above-described embodiment, the controller 30 sets a virtual wall VW based on the output of the LIDAR. However, the controller 30 may set a virtual wall VW based on the output of a camera serving as the image capturing device 80, which is another example of the surroundings monitoring device. In this case, the controller 30 may use a known feature extraction technique such as the Hough transform to extract the regularity of the shape of an object, and set a virtual wall VW based on the extracted regularity.

In the above-described embodiment, a virtual wall VW is set as a plane extending vertically. However, the virtual wall VW may be set as a plane extending horizontally, or may be set as a plane extending obliquely relative to the horizontal plane. Further, the virtual wall VW may be set as a curved surface.

Figure 12:
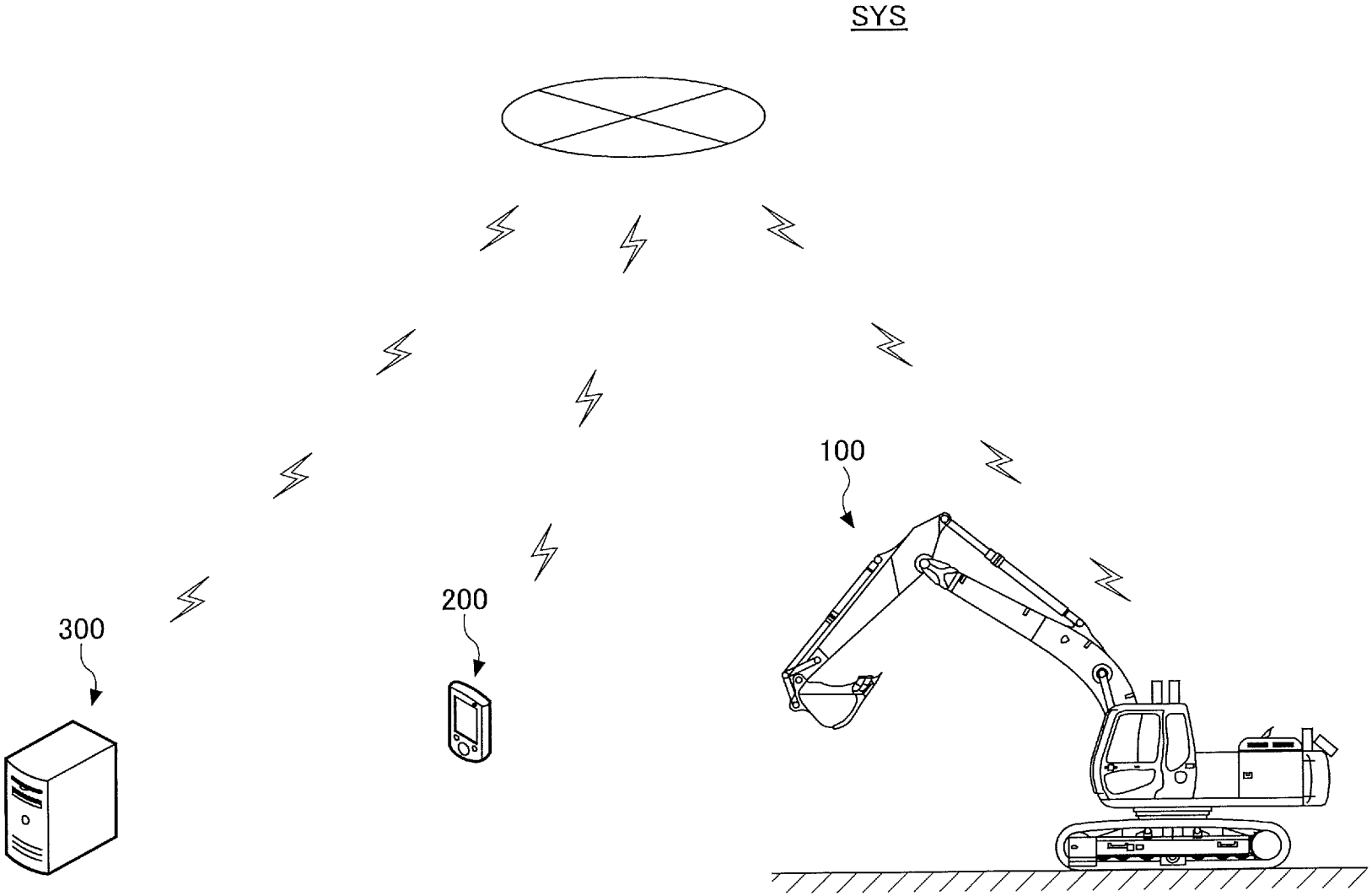
FIG. 12 is a schematic diagram illustrating an example configuration of a shovel management system.

Further, information acquired by the shovel 100 may be shared with a manager and other shovel operators through a shovel management system SYS as illustrated in FIG. 12. FIG. 12 is a schematic diagram illustrating an example configuration of the shovel management system SYS. The management system SYS is a system that manages shovels 100. In the present embodiment, the management system SYS is mainly configured by a shovel 100, an assist device 200, and a management apparatus 300. Each of the shovel 100, the assist device 200, and the management apparatus 300 includes a communications device. The shovel 100, the assist device 200, and the management apparatus 300 includes a communications device are directly or indirectly connected to each other via a cellular phone communication network, a satellite communication network, or a near field communication network. The management system SYS may include one or more shovels 100, one or more assist devices 200, and one or more management apparatuses 300. In the example illustrated in FIG. 12, the management system SYS includes the one shovel 100, the one assist device 200, and the one management apparatus 300.

The assist device 200 is typically a portable terminal device, and may be, for example, a computer carried by a worker or the like at a construction site, such as a notebook personal computer (PC), a tablet PC, or a smartphone. The assist device 200 may be a computer carried by the operator of the shovel 100. Alternatively, the assist device 200 may be a stationary terminal apparatus.

The management apparatus 300 is typically a stationary terminal apparatus, and may be, for example, a server computer installed in a management center or the like outside a construction site. The management apparatus 300 may be a portable computer (for example, a portable terminal device such as a notebook PC, a tablet PC, or a smartphone).

At least one of the assist device 200 and the management apparatus 300 (hereinafter referred to as the "assist device 200 or the like") may include a monitor and a remote operation device. In this case, the operator operates the shovel 100 while using the remote operation device. The remote operation device is connected to the controller 30 via a communication network such as a cellular phone communication network, a satellite communication network, or a near field communication network.

In the above-described shovel management system SYS, the controller 30 of the shovel 100 may transmit information related to virtual walls VW to the assist device 200. The information related to virtual walls VW includes at least one of information related to the positions of the virtual walls VW, information related to the time (hereinafter referred to as the "determination time") at which it is determined that there is a possibility that a part of the shovel 100 may cross a virtual wall VW, information related to the position of the part of the shovel 100 at the determination time, information related to work contents of the shovel 100 at the determination time, information related to the work environment of the shovel 100 at the determination time, and information related to the movement of the shovel 100 measured at the determination time and measured for a period of time before and after the determination time. The information related to the work environment of the shovel 100 includes at least one of information related to the inclination of the ground and information related to the weather. The information related to the movement of the shovel 100 includes at least one of a pilot pressure and the pressure of hydraulic oil in a hydraulic actuator.

The controller 30 may transmit an image captured by the image capturing device 80 to the assist device 200. The image captured by the image capturing device 80 may include a plurality of images captured for a predetermined period of time including the determination time. The predetermined period of time may include a period of time prior to the determination time.

Further, the controller 30 may transmit at least one of information related to work contents of the shovel 100 performed for a predetermined period of time including the determination time, information related to the orientation of the shovel 100, and information related to the orientation of the excavation attachment, to the assist device 200. As a result, it becomes possible for the manager using the assist device 200 and the like to acquire information related to a work site. That is, the manager can analyze the cause of a situation in which the movement of the shovel 100 is slowed or stopped. Further, the manager can improve the work environment of the shovel 100 based on the analysis results.

Further, the controller 30 may be configured such that the operator can change the position of a virtual wall VW or generate a new virtual wall VW.

Figure 13:
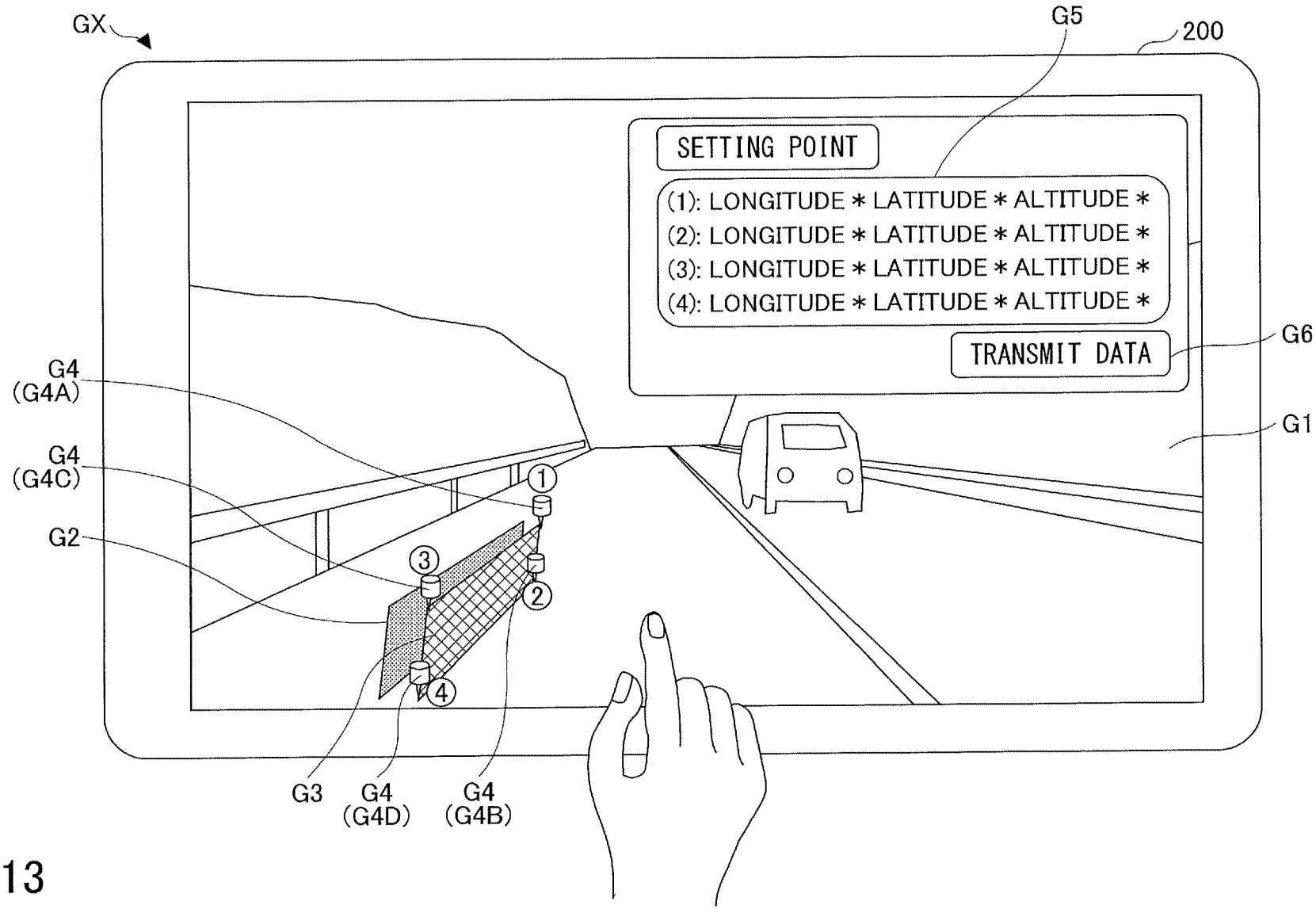
FIG. 13 is a diagram illustrating an example of an image displayed on an assist device.

FIG. 13 illustrates an example in which the operator changes the position of a virtual wall VW, set by the virtual wall setting part 30A of the controller 30, through the assist device 200. Specifically, FIG. 13 illustrates an example of an image GX displayed on a display device of the assist device 200.

In the example of FIG. 13, the assist device 200 is a tablet PC, and includes the display device, an image capturing device, and a positioning device. The display device includes a touch panel. The positioning device is a GNSS compass, and is configured to detect not only the position of the assist device 200, but also the orientation of the assist device 200. That is, the assist device 200 is configured to identify the position of an object included in an image captured by the image capturing device.

The image GX includes an image G1 and graphic shapes G2 through G6. The image G1 is an image (hereinafter referred to as a "camera image") captured by a camera installed on the assist device 200. In the example of FIG. 13, the operator captures an image of a space on the road where a virtual wall VW is set. The display device of the assist device 200 displays the camera image in real time.

The graphic shape G2 represents a virtual wall VW set by the virtual wall setting part 30A. In the example of FIG. 13, the display device of the assist device 200 displays the graphic shape G2 representing the rectangular virtual wall VW extending along the left lane of the road. The assist device 200 receives information related to the virtual wall VW via the communication device. The assist device 200 associates two-dimensional coordinates in the camera image with three-dimensional coordinates in real space, based on the output of the positioning device. Thus, the assist device 200 can associate the two-dimensional coordinates in the camera image with the three-dimensional coordinates of a plurality of vertexes defining the virtual wall VW. Further, the assist device 200 can use an augmented reality technology (AR technology) to superimpose and display an AR image representing the virtual wall VW on the camera image.

The graphic shape G3 represents the repositioned virtual wall VW. In the example of FIG. 13, the display device of the assist device 200 displays the graphic shape G3 representing the virtual wall VW that has slightly moved to the right from the position set by the virtual wall setting part 30A. The operator can change the position of the virtual wall VW by touching an area on the touch panel where the graphic shape G2 is displayed and dragging the finger to the right.

Alternatively, the operator may change the position of the virtual wall VW by touching one point on the touch panel to which the operator desires to move the virtual wall VW. Alternatively, the operator may change the position of the virtual wall VW by touching four points on the touch panel corresponding to four vertexes defining the virtual wall VW simultaneously or in order.

The graphic shape G4 represents vertexes of the repositioned virtual wall VW. In the example of FIG. 13, the graphic shape G4 includes four graphic shapes G4A through G4D indicating four respective vertexes of the repositioned virtual wall VW.

The graphic shape G5 represents information on the repositioned virtual wall VW. In the example of FIG. 13, the graphic shape G5 indicates the latitude, the longitude, the altitude of each of the four vertexes of the repositioned virtual wall VW as the three-dimensional coordinates of each of the four vertexes.

The graphic shape G6 represents a software button for transmitting information from the assist device 200 to an external device. In the example of FIG. 13, after changing the position of the virtual wall VW, the operator can transmit information on the virtual wall VW to the controller 30 of the shovel 100, by touching an area on the touch panel where the graphic shape G6 is displayed.

With the above-described information, the operator can use the assist device 200 to change the position of each of a plurality of virtual walls VW, as illustrated in FIG. 4 and FIG. 8, to any position.

What is claimed is:

1. A shovel comprising:

a lower traveling body;

an upper turning body turnably mounted on the lower traveling body;

an actuator mounted on the lower traveling body or the upper turning body;

a sensor attached to the upper turning body; and a hardware processor configured to:

identify that a plurality of obstacles is arranged in a work environment;

determine that the plurality of obstacles is arranged continuously, linearly, symmetrically, or repeatably; and generate a virtual wall in response to the determination that the plurality of obstacles is arranged continuously, linearly, symmetrically, or repeatably;

wherein the generated virtual wall defines a closed working space in which the shovel is located and may perform work; and wherein the hardware processor is configured to restrict movement of the actuator based on a positional relationship between the generated virtual wall and the shovel; wherein the hardware processor is configured to detect the plurality of obstacles based on output of the sensor and generate the virtual wall based on the detected plurality of obstacles; and wherein the hardware processor is configured to derive, based on a feature extraction technique, a regularity of continuity, linearity, symmetry or repeatability of the plurality of obstacles based on the output of the sensor, and generate the virtual wall based on the derived regularity.

2. The shovel according to claim 1, wherein the plurality of obstacles is a plurality of road cones disposed in a vicinity of the shovel.

3. The shovel according to claim 1, wherein the hardware processor is configured to slow or stop the movement of the actuator in response to determining that a part of the shovel crosses the virtual wall.

4. The shovel according to claim 1, wherein the hardware processor is configured to slow or stop the movement of the actuator to prevent a part of the shovel from crossing the virtual wall.

5. The shovel according to claim 1, wherein the plurality of obstacles includes one or more pre-identified first obstacles and second obstacles whose positional relationship change depending on a construction situation, data on the one or more pre-identified first obstacles are preliminarily input into a construction plan drawing that is electronic design data, the hardware processor is configured to detect the second obstacles based on output of the sensor, and the generation of the virtual wall is based on the detected second obstacles and the construction plan.

6. The shovel according to claim 1, wherein the sensor is attached to the upper turning body such that a virtual line representing a boundary of a monitoring range forms an angle of 90 degrees or more with respect to a virtual plane that is perpendicular to a turning axis.

7. The shovel according to claim 1, wherein the sensor includes a plurality of sensors, the plurality of sensors including a first sensor configured to monitor an area obliquely above the shovel and a second sensor configured to monitor an area obliquely below the shovel, wherein a monitoring range of the first sensor partially overlaps with a monitoring range of the second sensor.

8. The shovel according to claim 1, wherein the generated virtual wall extends vertically with respect to a ground.

9. The shovel according to claim 1, further comprising:

an excavation attachment attached to the upper turning body, wherein the hardware processor is configured to separately determine a positional relationship between the virtual wall and each of the lower traveling body, the upper turning body, and the excavation attachment.

10. The shovel according to claim 1, wherein the generated virtual wall defines a closed three-dimensional space surrounding the shovel as the closed working space.

11. A shovel comprising:

a lower traveling body;

an upper turning body turnably mounted on the lower traveling body;

an actuator mounted on the lower traveling body or the upper turning body;

a sensor attached to the upper turning body and configured to detect an object in a vicinity of the shovel; and a hardware processor configured to identify that a plurality of obstacles is arranged in a work environment, based on an output of the sensor, determine that the plurality of obstacles is arranged continuously, linearly, symmetrically, or repeatably; and generate a virtual wall in response to the determination that the plurality of obstacles is arranged continuously, linearly, symmetrically, or repeatably;

wherein the generated virtual wall defines a closed working space in which the shovel is located and may perform work; and wherein the hardware processor is configured to restrict movement of the actuator based on a positional relationship between the generated virtual wall and the shovel; wherein the hardware processor is configured to generate the virtual wall based on the identified plurality of obstacles; and wherein the hardware processor is configured to derive, based on a feature extraction technique, a regularity of continuity, linearity, symmetry or repeatability of the plurality of obstacles based on the output of the sensor, and generate the virtual wall based on the derived regularity.

12. An assist device for a shovel, comprising a hardware processor configured to:

identify that a plurality of obstacles is arranged in a work environment;

determine that the plurality of obstacles is arranged continuously, linearly, symmetrically, or repeatably; and generate a virtual wall in response to the determination that the plurality of obstacles is arranged continuously, linearly, symmetrically, or repeatably;

wherein the generated virtual wall defines a closed working space in which the shovel is to be located and in which the shovel may perform work; and wherein the hardware processor is configured to restrict movement of an actuator of the shovel based on a positional relationship between the generated virtual wall and the shovel; wherein the hardware processor is configured to detect the plurality of obstacles based on output of a sensor attached to the shovel and generate the virtual wall based on the detected plurality of obstacles; and wherein the hardware processor is configured to derive, based on a feature extraction technique, a regularity of continuity, linearity, symmetry or repeatability of the plurality of obstacles based on the output of the sensor, and generate the virtual wall based on the derived regularity.

* * * * *